US012357051B2

(12) United States Patent
Garrison et al.

(10) Patent No.: US 12,357,051 B2
(45) Date of Patent: Jul. 15, 2025

(54) HELMET WITH CARBON CAGE AND ADJUSTABLE FIT SYSTEM

(71) Applicant: Trek Bicycle Corporation, Waterloo, WI (US)

(72) Inventors: Jesse Lawrence Garrison, Madison, WI (US); Mark Wilke, Oconomowoc, WI (US); Eric Kuang, Waterloo, WI (US)

(73) Assignee: TREK BICYCLE CORPORATION, Waterloo, WI (US)

( * ) Notice: Subject to any disclaimer, the term of this patent is extended or adjusted under 35 U.S.C. 154(b) by 0 days.

(21) Appl. No.: 17/404,154

(22) Filed: Aug. 17, 2021

(65) Prior Publication Data

US 2023/0059228 A1 Feb. 23, 2023

(51) Int. Cl.

| | |
|---|---|
| ***A42B 3/14*** | (2006.01) |
| ***A42B 3/04*** | (2006.01) |
| ***A42B 3/06*** | (2006.01) |
| ***A42B 3/12*** | (2006.01) |

(52) U.S. Cl.

CPC ..... *A42B 3/063* (2013.01); *A42B 3/125* (2013.01); *A42B 3/04* (2013.01); *A42B 3/14* (2013.01)

(58) Field of Classification Search

CPC ..... A42B 3/06; A42B 3/062; A42B 3/063; A42B 3/064; A42B 3/08; A42B 3/14; A42B 3/10; A42B 3/04; A42B 3/12; A42B 3/105; A42B 3/142; A42B 3/147

See application file for complete search history.

(56) References Cited

U.S. PATENT DOCUMENTS

| | | | | |
|---|---|---|---|---|
| 2,753,562 A * | 7/1956 | McDonald | ..... | A42B 3/14 2/8.1 |
| 2,909,957 A * | 10/1959 | Rapata | ..... | F16B 13/02 24/453 |
| 5,638,551 A * | 6/1997 | Lallemand | ..... | A42B 3/085 2/421 |
| 5,774,901 A * | 7/1998 | Minami | ..... | A42B 3/147 2/421 |
| 6,009,561 A * | 1/2000 | Bullock | ..... | A42B 3/227 24/297 |
| 6,401,261 B1 * | 6/2002 | Arney | ..... | A42B 3/085 2/421 |

(Continued)

FOREIGN PATENT DOCUMENTS

| | | | | |
|---|---|---|---|---|
| EP | 3583862 | 12/2019 | | |
| KR | 101617366 | 5/2016 | | |
| KR | 101617366 B1 * | 5/2016 | ..... | A42B 3/066 |

OTHER PUBLICATIONS

Extended European Search Report for EP 22189794 dated Jan. 20, 2023; pp. 1-7.

*Primary Examiner* — Sally Haden
*Assistant Examiner* — Giao Qt Hoang
(74) *Attorney, Agent, or Firm* — Bell & Manning, LLC

(57) ABSTRACT

A helmet includes an outer shell and an impact absorbing layer adjacent to the outer shell. The helmet also includes a fit system mounted to the impact absorbing layer. The fit system includes a rear portion that includes a rotational mount having a ball and an extension mounted to the ball. The fit system also includes a rear mount that includes a plurality of grooves. Each groove in the plurality of grooves is configured to receive the rotational mount of the rear portion of the fit system.

13 Claims, 24 Drawing Sheets

(56) References Cited

U.S. PATENT DOCUMENTS

| | | | | |
|---|---|---|---|---|
| 6,425,142 | B2 | 6/2002 | Sasaki et al. | |
| 6,449,776 | B1 * | 9/2002 | Musal | A42B 3/147 2/418 |
| 7,069,601 | B1 * | 7/2006 | Jacobsen | A42B 3/08 2/421 |
| 7,178,175 | B2 | 2/2007 | Rogers et al. | |
| 8,032,993 | B2 | 9/2011 | Musal | |
| 9,756,893 | B2 * | 9/2017 | Muller | A42B 3/142 |
| 9,801,424 | B2 * | 10/2017 | Mazzarolo | A42B 3/12 |
| 10,420,385 | B2 | 9/2019 | Lakes et al. | |
| 2009/0044315 | A1 * | 2/2009 | Belanger | A42B 3/324 2/420 |
| 2009/0222978 | A1 * | 9/2009 | Fang | A42B 3/145 2/421 |
| 2010/0050324 | A1 | 3/2010 | Musal | |
| 2013/0067643 | A1 * | 3/2013 | Musal | A42B 3/324 2/424 |
| 2013/0239303 | A1 * | 9/2013 | Cotterman | A42B 3/324 2/417 |
| 2014/0366252 | A1 * | 12/2014 | Mazzarolo | A42B 3/127 2/414 |
| 2015/0096113 | A1 * | 4/2015 | Garneau | A42B 3/062 2/414 |
| 2017/0347736 | A1 * | 12/2017 | Penner | A42B 3/145 |
| 2018/0092424 | A1 * | 4/2018 | Hall | A42B 3/142 |
| 2018/0325203 | A1 * | 11/2018 | Cotterman | A42B 3/12 |
| 2018/0325204 | A1 * | 11/2018 | Jacobsen | A42B 3/128 |
| 2019/0166944 | A1 * | 6/2019 | Mini Townson | A42B 3/127 |
| 2019/0343215 | A1 | 11/2019 | Musal et al. | |
| 2019/0380418 | A1 | 12/2019 | Musal | |
| 2020/0085129 | A1 | 3/2020 | Lakes et al. | |
| 2021/0267298 | A1 * | 9/2021 | Peace, III | A42B 3/0473 |
| 2022/0175074 | A1 * | 6/2022 | Rietdyk | A42B 3/08 |

* cited by examiner

HELMET WITH CARBON CAGE AND ADJUSTABLE FIT SYSTEM

BACKGROUND

A cycling helmet is often worn by bicyclists as a safety precaution. Traditional helmets utilize a stiff foam material such as expanded polystyrene (EPS) surrounded by a rigid shell to help reduce the peak energy of an impact. Traditional helmets also utilize an adjustable strap system such that the helmet can be securely fastened to the user's head. Additionally, some helmets include foam padding in various areas to improve comfort and prevent chafing.

SUMMARY

An illustrative helmet includes an outer shell and an impact absorbing layer adjacent to the outer shell. The helmet also includes a fit system mounted to the impact absorbing layer. The fit system includes a rear portion that includes a rotational mount having a ball and an extension mounted to the ball. The fit system also includes a rear mount that includes a plurality of grooves. Each groove in the plurality of grooves is configured to receive the rotational mount of the rear portion of the fit system.

An illustrative method of making a helmet includes thermoforming a first carbon section for a helmet. The first carbon section includes a first overlap area. The method also includes thermoforming a second carbon section for the helmet. The second carbon section includes a second overlap area. The method also includes aligning the first overlap area with the second overlap area such that there is a gap between the first overlap area and the second overlap area. The method further includes placing an adhesive in the gap to adhere the first carbon section to the second carbon section to form a carbon cage.

Other principal features and advantages of the invention will become apparent to those skilled in the art upon review of the following drawings, the detailed description, and the appended claims.

BRIEF DESCRIPTION OF THE DRAWINGS

Illustrative embodiments will hereafter be described with reference to the accompanying drawings, wherein like numerals denote like elements. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

FIG. 2I is a rear view of the helmet shell with overlapping carbon sections in accordance with an illustrative embodiment.

FIG. 2O is a first close-up partial view depicting overlapped carbon sections in accordance with an illustrative embodiment.

DETAILED DESCRIPTION

Many traditional cycling helmets include a fit system, or yoke, that provides points of contact between the user and the helmet. The fit system may include bands or straps that extend around a circumference of the user's head and that keep the main body of the helmet from coming into contact with the user's head. This configuration can also be used to create a space, or air gap, between the user's head and the main body of the helmet. The air gap enhances air flow, which helps to reduce heat and sweat when the helmet is worn during cycling.

Traditional helmet fit systems are often adjustable such that the helmet is able to fit a range of different head sizes. The adjustable feature allows the circumference of the band/strap/cord that goes around the head of the user to be increased or decreased to a desired size. The adjustment mechanism is often in the form of a laced ratcheting system, such as the BOA® system or similar. This circumference adjustment is generally the only adjustable feature in traditional helmet fit systems. Described herein is a fit system that provides additional adjustment options which help to facilitate a better fit and more comfort for the user. The proposed fit system also provides improved storage options for the helmet, as discussed in more detail below.

Figure 1A:
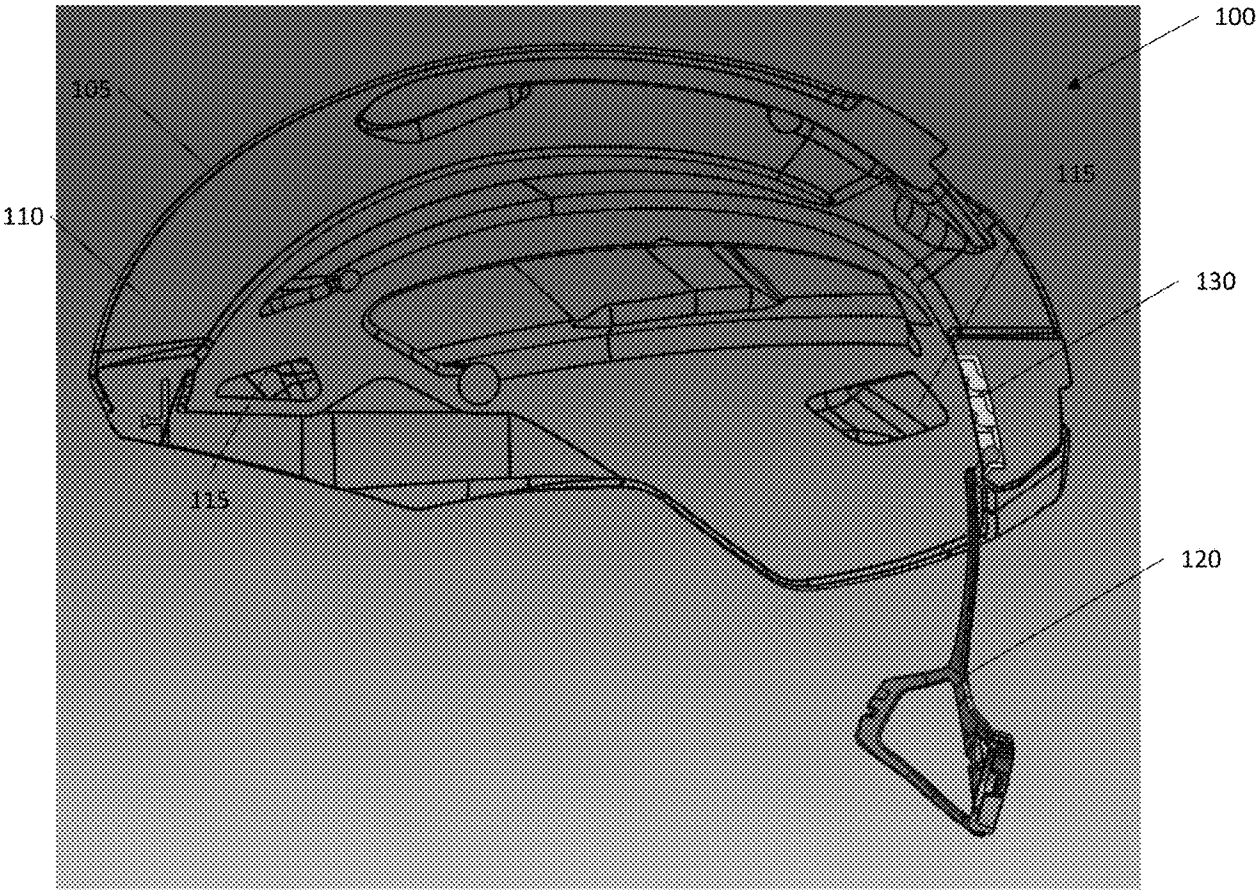
FIG. 1A is a first cross-sectional view of a helmet with an adjustable fit system in accordance with an illustrative embodiment.
Figure 1B:
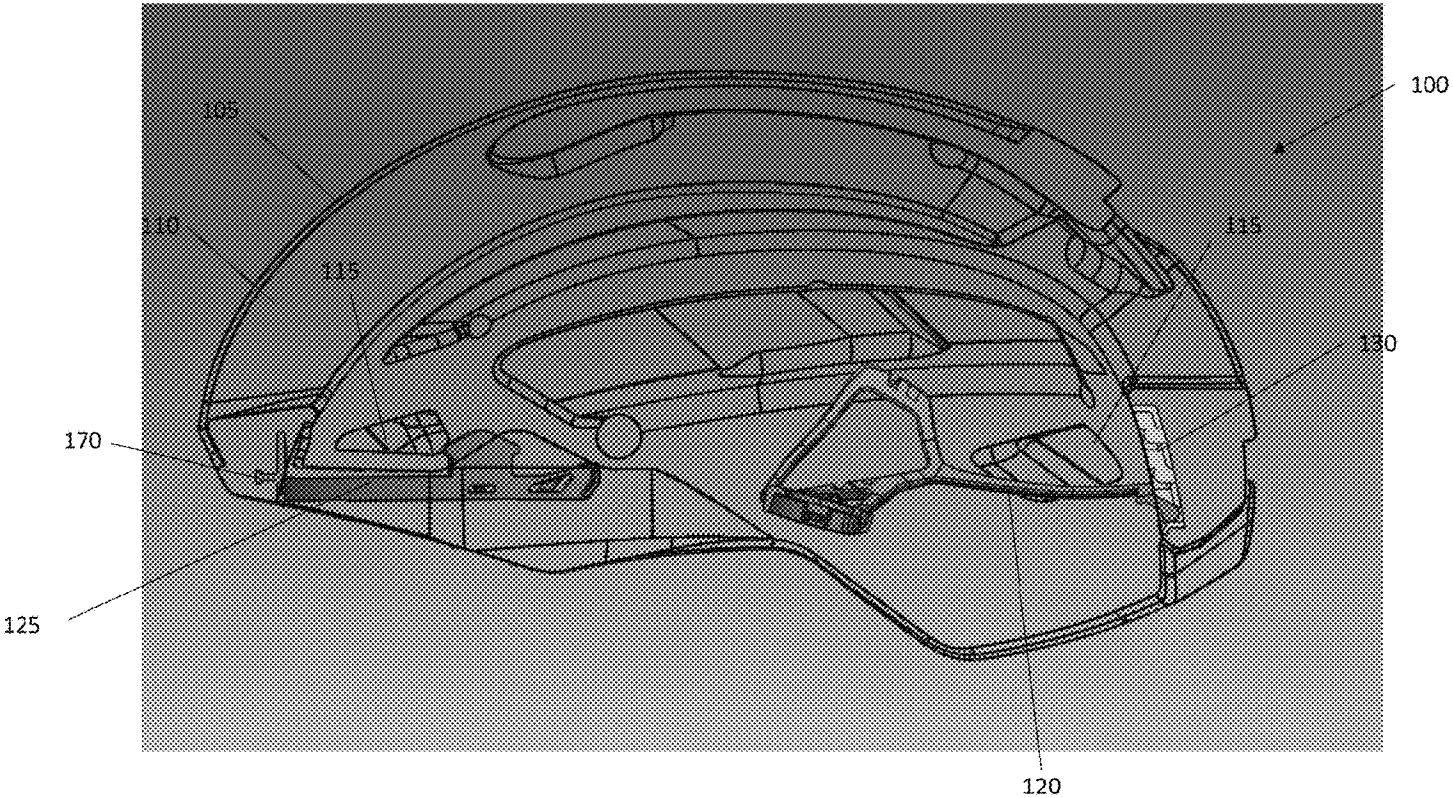
FIG. 1B is a second cross-sectional view of the helmet with an adjustable fit system in accordance with an illustrative embodiment.
Figure 1C:
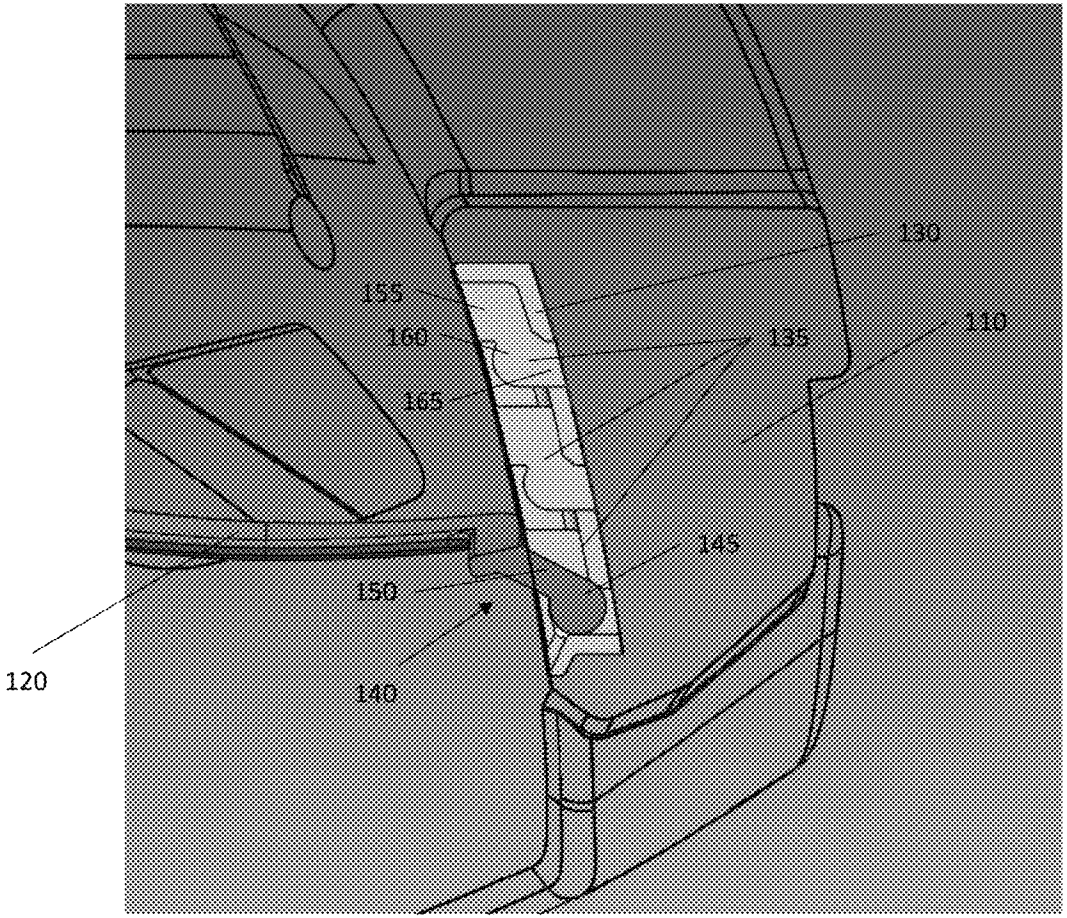
FIG. 1C is a partial cross-sectional close up view of a rear mount for the adjustable fit system in accordance with an illustrative embodiment.

FIG. 1A is a first cross-sectional view of a helmet with an adjustable fit system in accordance with an illustrative embodiment. FIG. 1B is a second cross-sectional view of the helmet with an adjustable fit system in accordance with an illustrative embodiment. FIG. 1C is a partial cross-sectional close up view of a rear mount for the adjustable fit system in accordance with an illustrative embodiment. As shown, the helmet 100 includes an outer shell 105 and an impact absorbing layer 110 mounted to the other shell. The outer shell 105 can be made from plastic, resin, fiber, polycarbonate, polyethylene, terephthalate (PET), acrylonitrile butadiene styrene, polyethylene (PE), polyvinyl chloride (PVC), vinyl nitrile (VN), fiberglass, carbon fiber, or other similar material. The outer shell 105 provides a rigid outer layer for the helmet 100.

In an illustrative embodiment, the impact absorbing layer 110 can be made of expanded polystyrene (EPS). In alternative embodiments, the impact absorbing layer 110 can be made of one or more layers of the same or similar materials, including an impact energy absorbing material such as expanded polypropylene (EPP), expanded polyurethane (EPU), vinyl nitrile (VN), or any other material that absorbs impact energy through deformation. The impact absorbing layer 110 can be formed by blowing, molding, or any other technique known to those of skill in the art. In one embodiment, an inner surface of the outer shell 105 is coated with an adhesive that is used to attach the impact absorbing layer 110 to the outer shell 105.

As shown, the outer shell 105 is formed to include vent openings that form vents 115. The impact absorbing layer 110 also includes vent openings that are aligned with the vent openings in the outer shell 105 to form the vents 115. The vents 115 are included to improve airflow, increase breathability, and reduce the overall weight of the helmet 100.

The helmet 100 also includes a fit system, only a portion of which is shown in the views of FIGS. 1A-1D. The fit system includes a rear portion 120 mounted to the back of the helmet and a front portion 125 mounted to the front of the helmet. More specifically, the back of the helmet 100 includes a rear mount 130 for the fit system. The rear mount 130 is embedded within the impact absorbing layer 110 in an illustrative embodiment. For example, the rear mount 130 can be co-molded with the impact absorbing layer 110 in one implementation. Alternatively, an adhesive can be used to mount the rear mount 130 into a cavity formed in the impact absorbing layer 110.

As shown, the rear mount 130 includes three different positions at which the rear portion 120 of the fit system can be mounted. In alternative embodiments, a different number of positions may be used, such as one, two, four, six, etc. These adjustable positions allow the rear portion 120 of the fit system to be raised or lowered relative to the interior of the helmet 100 (i.e., relative to the impact absorbing layer 110). The adjustments allow the user to control the position of the fit system on his/her head, which allows the user to achieve a more comfortable fit.

As best shown in the close up view of FIG. 1C, the rear mount 130 of the fit system includes separate grooves 135 that provide the adjustability. The depicted embodiment includes three grooves corresponding to the three positions at which the rear portion 120 of the fit system can be mounted. As discussed, alternative implementations may include a different number of grooves corresponding to a different number of positions. Each of the grooves 135 is shaped to receive a rotational mount 140 that is attached to the rear portion 120 of the fit system. The rotational mount 140 includes a ball 145 mounted to an extension 150. As discussed in more detail below, this configuration of the rotational mount enables rotation of the rear portion 120 of the fit system. In alternative embodiments, a different configuration and/or shape may be used for the rotational mount 140 of the rear portion 120 of the fit system.

Each of the grooves 135 in the rear mount 130 is in the form of a curved channel that includes a first portion 155, a second portion 160, and a third portion 165 that are fluidly connected to one another and that approximate the shape of a backwards 'S'. The first portion 155 of the groove 135 extends substantially parallel to a line that extends from the front of the helmet to the back of the helmet. The second portion 160 of the groove 135 extends substantially perpendicular to a line that extends from the front of the helmet to the back of the helmet (i.e., the second portion 160 is substantially perpendicular to the first portion 155). The third portion 165 of the groove 135 extends substantially parallel to a line that extends from the front of the helmet to the back of the helmet (i.e., the third portion 165 is substantially parallel to the first portion 155 and substantially perpendicular to the second portion 160).

The ball 145 on the rotational mount 140 of the rear portion 120 of the fit system rests within the third portion 165 of the groove 135 and enables the rear portion 120 to pivot up or down. Specifically, the curved channel enables multiple positions for the rotational mount 140. For example, in a first position, the extension 150 of the rotational mount 140 is oriented so that the rear portion 120 of the fit system extends downward from the bottom of the helmet. In a second position, the extension 150 of the rotational mount 140 is oriented so that the rear portion 120 of the fit system is elevated and does not drop below a bottom of the helmet. FIG. 1A depicts the rear portion 120 of the fit system rotated in a down position, which is used when the helmet is to be worn by a user. FIG. 1B shows the rear portion 120 of the fit system rotated into an up position (or elevated storage position) that is used when the helmet is to be stored. This storage feature allows the helmet to be rested/stored on a flat surface without resting upon the rear portion 120 of the fit system. As a result, the rear portion 120 of the fit system does not become warped or otherwise misshapen during storage of the helmet 100.

In traditional helmets, the fit system is stationary and extends down from the main body of the helmet. As a result, when the helmet is set onto a flat surface, the bulk of the helmet presses down on the fit system, which can cause the fit system to warp and bend. If the helmet is stored in such a way for long periods of time, the fit system may become permanently warped/bent, which can adversely affect the comfort of the helmet. As discussed, the ability of the rear portion 120 of the fit system to rotate upward prevents the helmet from resting on the fit system during storage on a flat surface, which eliminates the potential for warping or bending of the fit system.

Figure 1D:
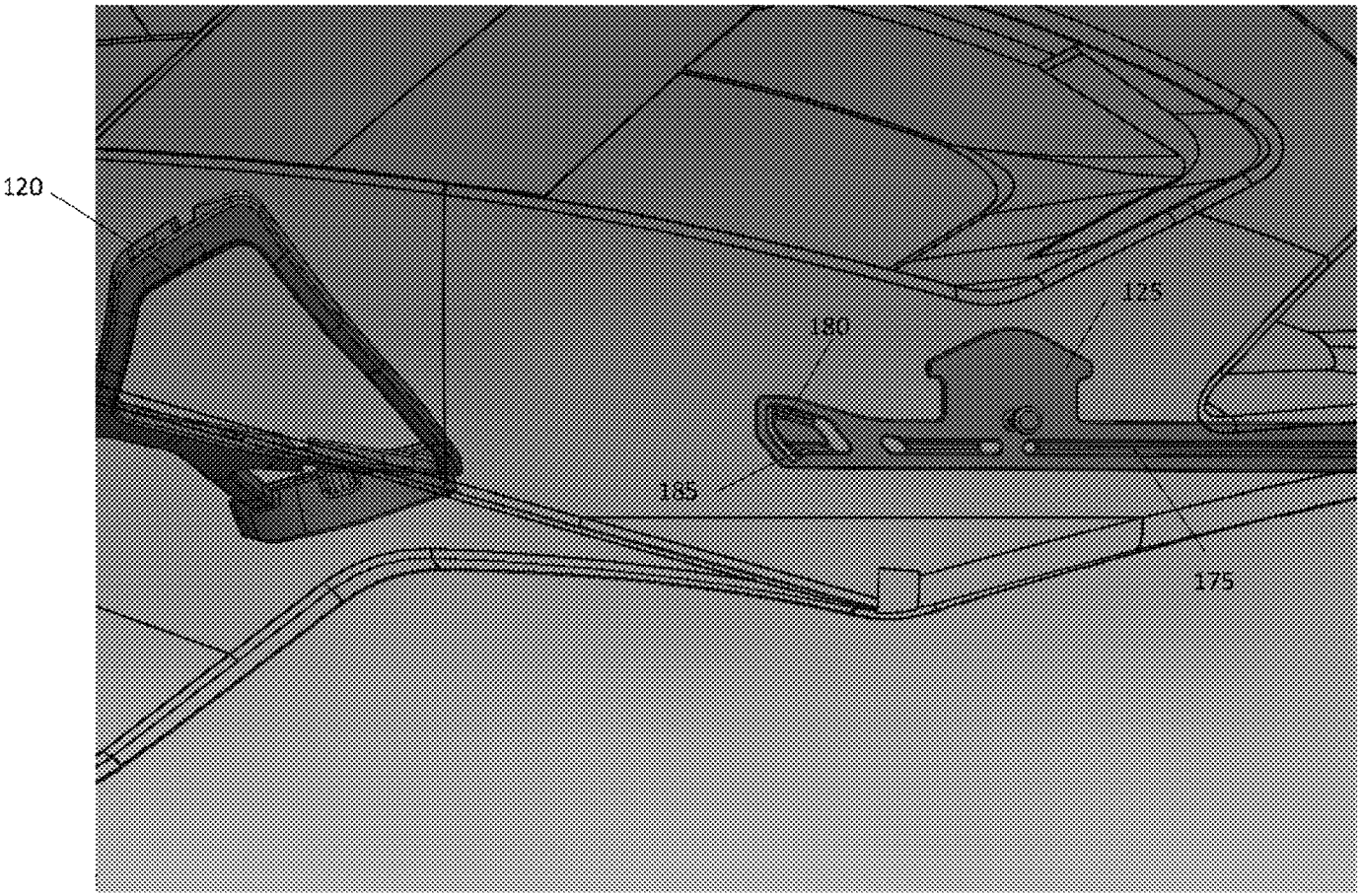
FIG. 1D is partial cross-sectional view of the helmet that depicts the front portion of the fit system in accordance with an illustrative embodiment.

The front portion 125 of the fit system is mounted to the impact absorbing layer 110 via an embedded mushroom plug 170. In alternative embodiments, a different method of mounting the front portion 125 of the fit system may be used such as an adhesive, rivet, etc. FIG. 1D is partial cross-sectional view of the helmet that depicts the front portion 125 of the fit system in accordance with an illustrative embodiment. As shown, the front portion 125 of the fit system includes a track 175 that is designed to receive a lace or cord of the fit system. The cord connects the rear portion 120 of the fit system to the front portion 125 of the fit system. In traditional helmets, the cord is used to adjust the fit system (i.e., adjust the overall circumference) so that a user is able to achieve a desired fit. As discussed, the cord may run through a ratchet tightening/loosening system such that the user can easily turn a dial to make adjustments. The cord can be made of plastic, cloth, string/rope, other fibers, etc.

In the fit systems of traditional helmets, the cord is statically mounted to the front and rear portions of the fit system and is not adjustable. Conversely, in the helmet 100 described herein, the position of the cord is adjustable, which provides further adjustability of the helmet for the user. As shown, the track 175 of the front portion 125 of the fit system includes a first track path 180 and a second track path 185. By running the cord through the first track path 180, the user is able to raise the position of the cord/lace relative to the user's ears. By running the cord through the second track path 185, the user is able to lower the position of the cord/lace relative to the user's ears. This adds additional flexibility to the helmet and allows it to be comfortable and functional for a wider range of users, as compared to traditional helmets. Regardless of which track path is used (i.e., either the first track path 180 or the second track path 185), the cord also runs through a main portion of the track 175.

In an illustrative embodiment, each side of the helmet has multiple track paths such that the cord of the fit system can be uniformly adjusted on each side of the helmet. The position of the multiple track paths can be on two terminal ends of the front portion of the fit system, as shown. When the helmet is worn, the multiple track paths can be positioned on the sides of the user's head, in between the ears and forehead. Alternatively, a different position may be used for the multiple track paths. For example, the multiple track paths may be positioned elsewhere in the front portion 125 of the fit system, or alternatively in the rear portion 120 of the fit system. Also, the depiction of FIG. 1D shows two different track paths that the user is able to run the cord through to make adjustments to the helmet. In alternative embodiments, additional track paths may be used, such as three track paths, four track paths, etc.

Figure 1E:
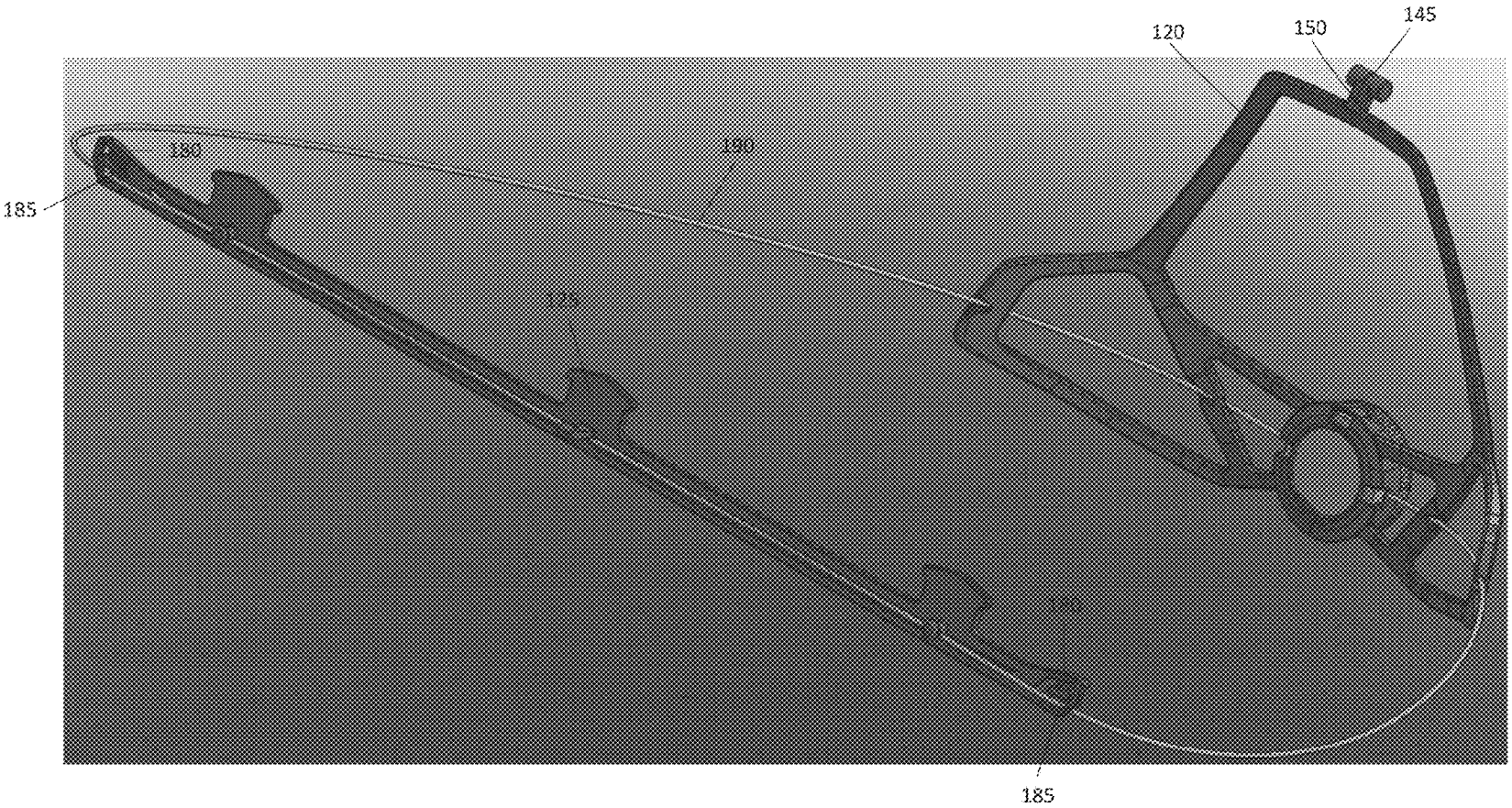
FIG. 1E is a perspective view of the fit system of the helmet in accordance with an illustrative embodiment.

FIG. 1E is a perspective view of the fit system of the helmet in accordance with an illustrative embodiment. As shown, a cord 190 (or lace) connects the rear portion 120 of the fit system to the front portion 125 of the fit system. In the depicted embodiment, the cord 190 runs through the second track paths 185 of the front portion 125 of the fit system. As discussed herein, the cord 190 can alternatively be run through the first track paths 180 of the front portion 125 of the fit system to adjust the position of the cord 190 relative to the ears of the user.

In another illustrative embodiment, the outer shell of the helmet can be in the form of a carbon cage that is formed through a thermoforming process. In some embodiments, at least a portion of this carbon cage is covered by EPS (or other) material, and the EPS or other impact absorbing material and the carbon cage form the outer shell of the helmet in combination. Traditional outer shells are often in the form of polycarbonate. The use of carbon allows for a lighter shell that is strong and durable. The thermoforming process was found to be an effective way to form the carbon cage. However, creation of a full 360° carbon cage cannot be done in a single form because, once cooled, it would be impossible to remove the formed carbon cage from the form without destroying the form (which is prohibitively expensive). The proposed carbon cage is thus formed in two or more pieces that are adhered to one another after being thermoformed.

Specifically, sections of the carbon cage are formed such that they overlap one another. An engineered gap is formed at each of the overlap areas to accommodate an adhesive, such as pressure sensitive tape, pressure sensitive foam tape, liquid adhesive such as glue or super glue, two part epoxy resin, etc. For example, a gap of 'x' millimeters (mm) may be used to accommodate an adhesive having a thickness of 'x' mm, where 'x' can be any value such as 0.1 mm, 0.3 mm, 0.5 mm, 0.75 mm, 1 mm, 1.5 mm, etc. depending on the adhesive used.

Figure 2A:
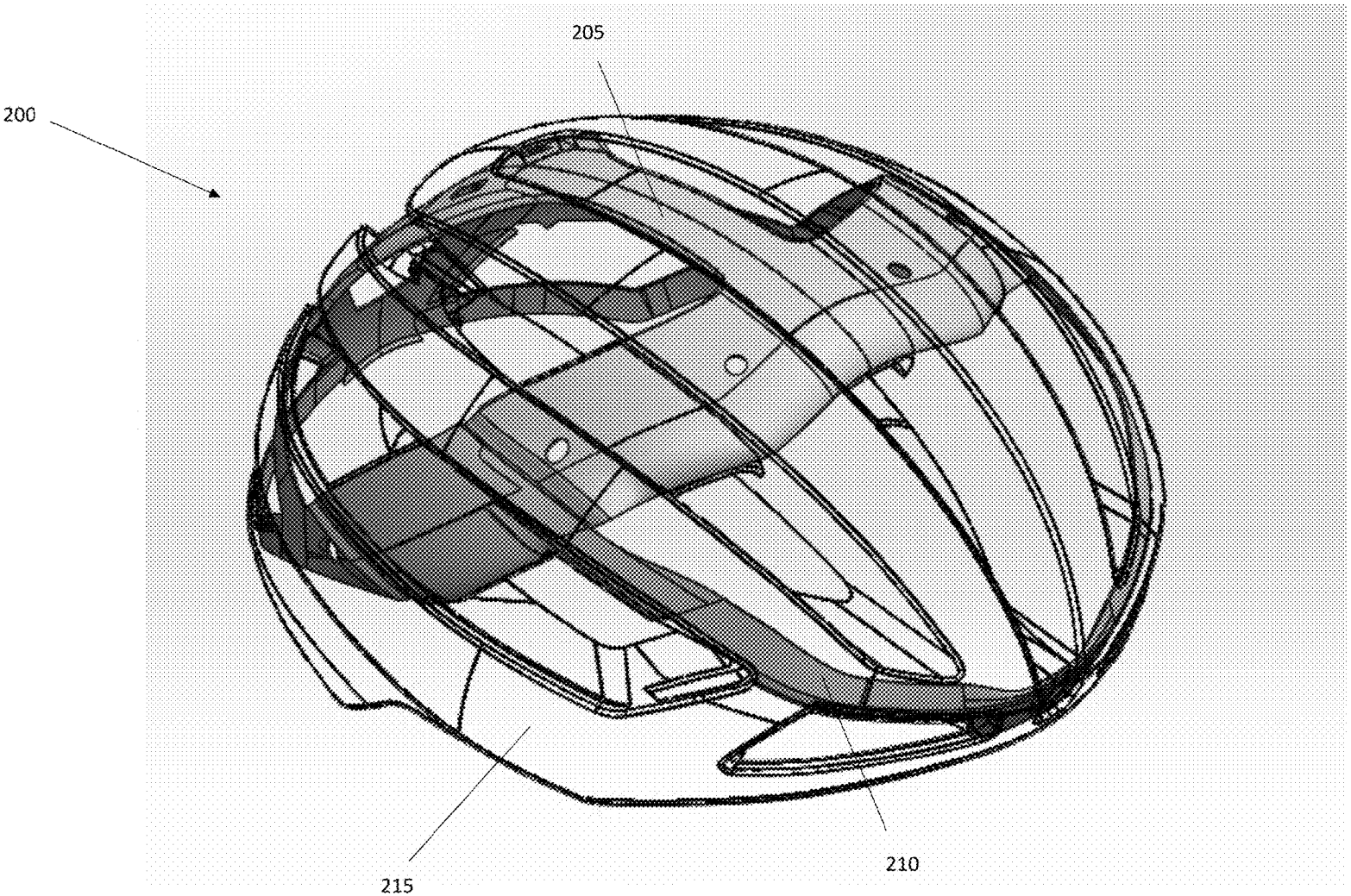
FIG. 2A is a perspective view of a helmet shell with overlapping carbon sections in accordance with an illustrative embodiment.
Figure 2B:
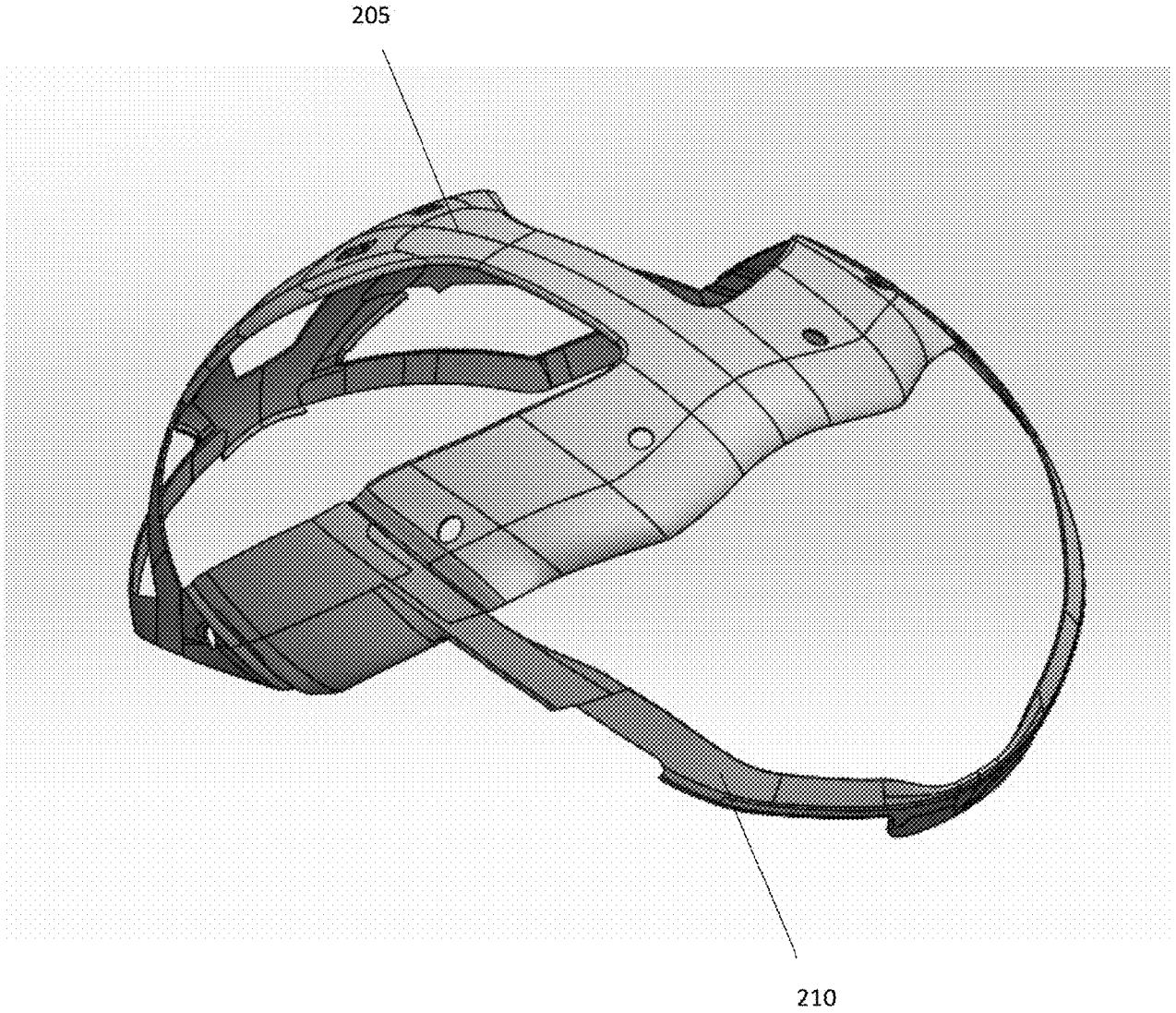
FIG. 2B is a perspective view of the overlapping carbon sections in accordance with an illustrative embodiment.
Figure 2C:
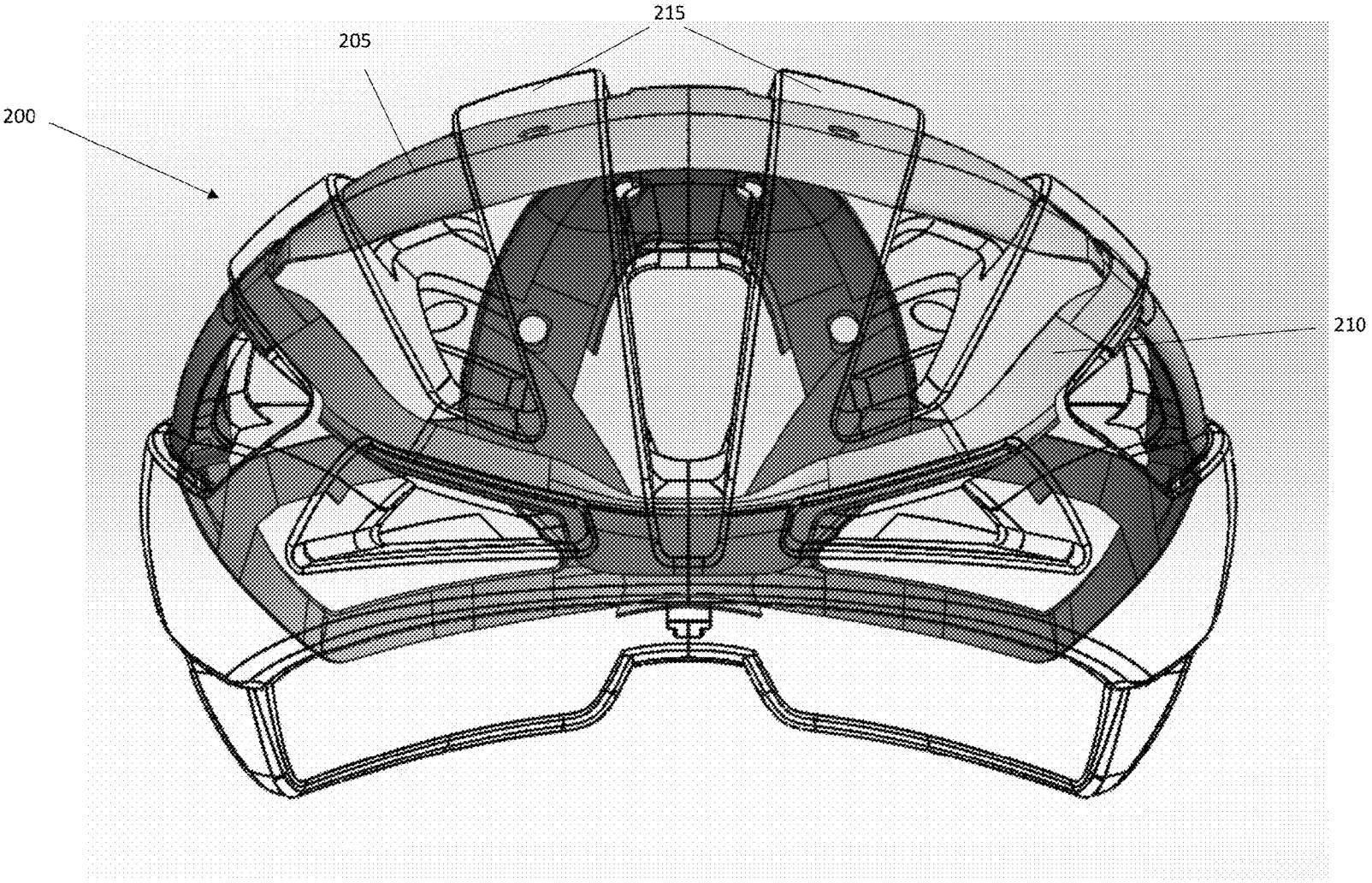
FIG. 2C is a front view of the helmet shell with overlapping carbon sections in accordance with an illustrative embodiment.
Figure 2D:
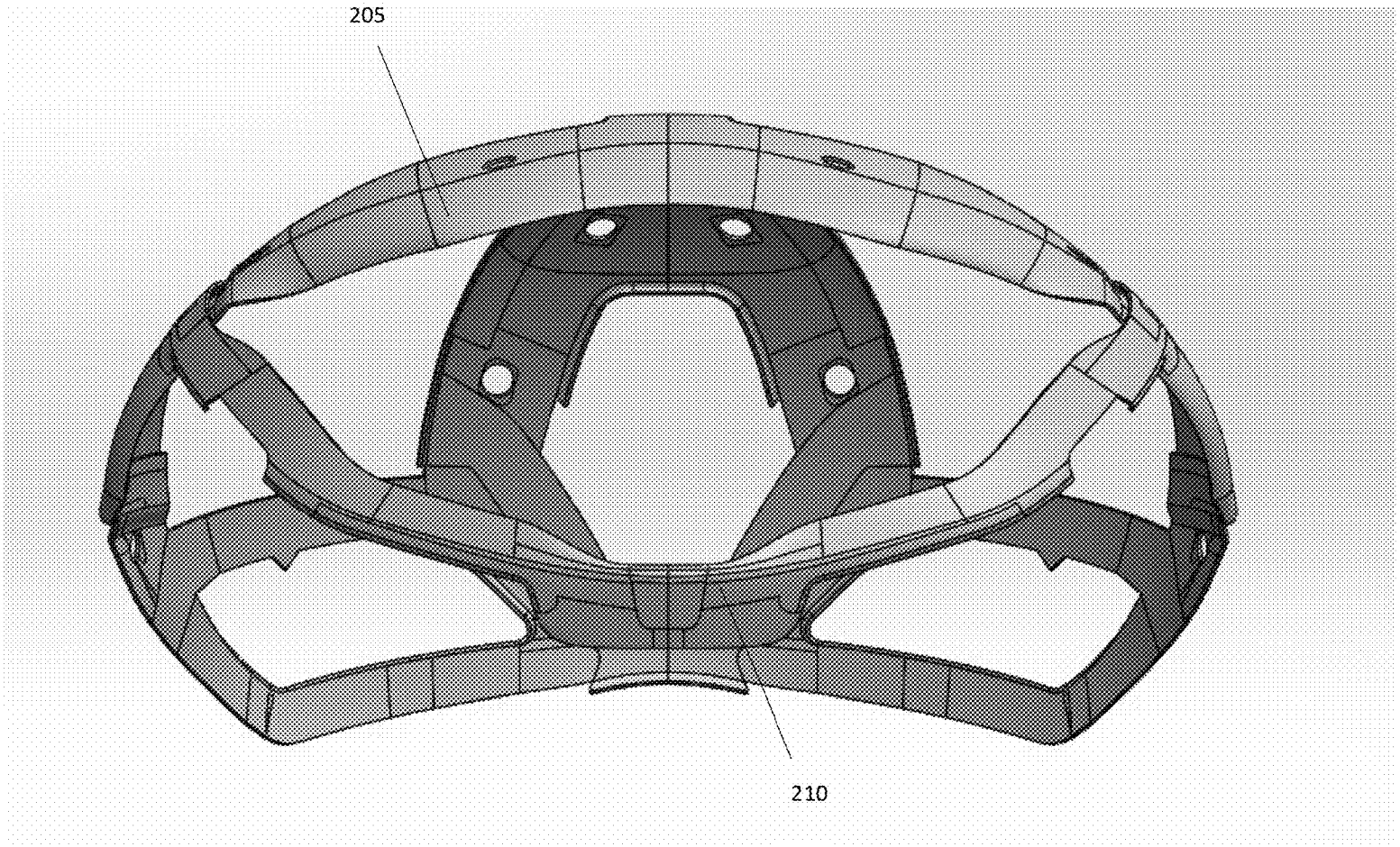
FIG. 2D is a front view of the overlapping carbon sections in accordance with an illustrative embodiment.
Figure 2E:
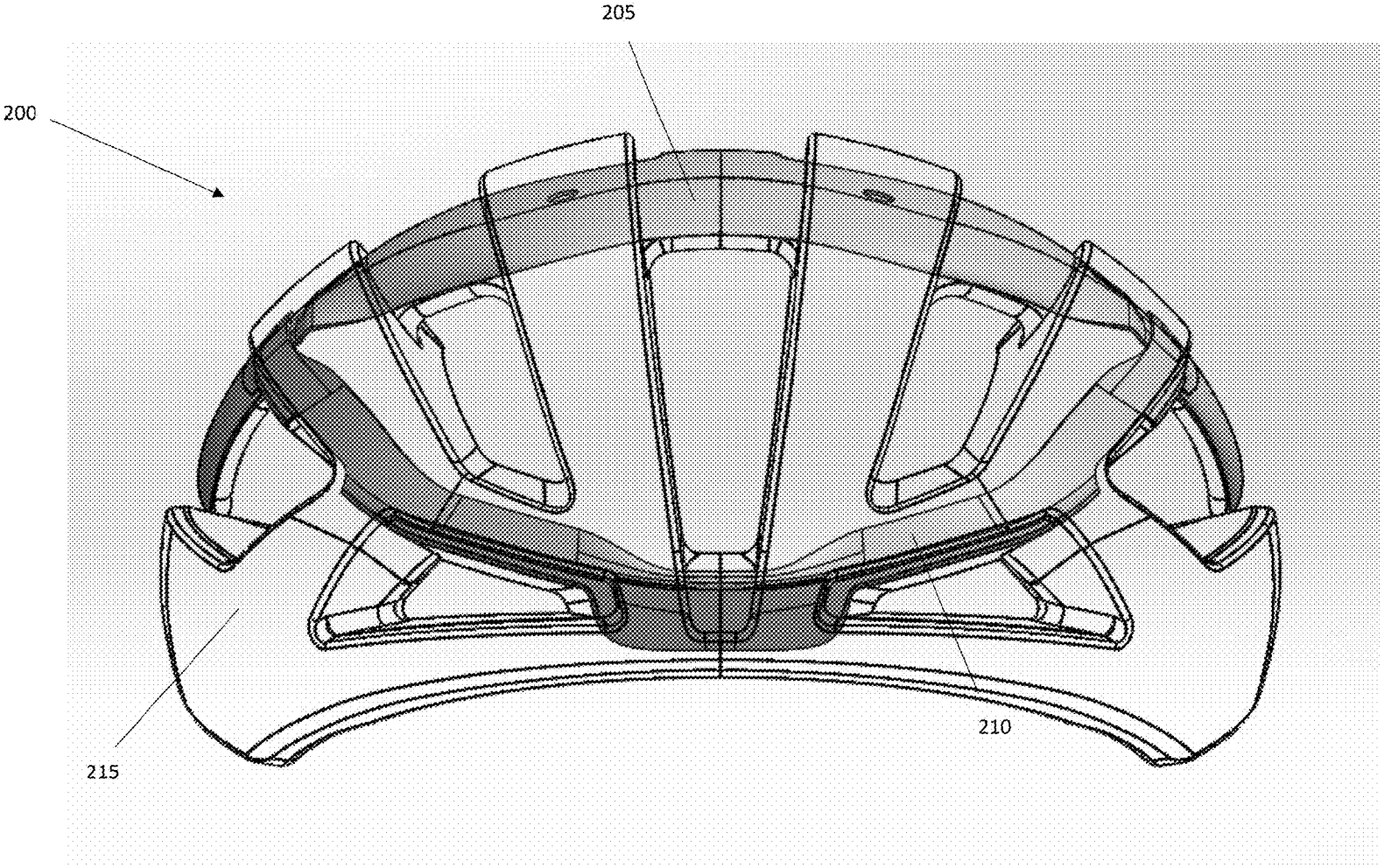
FIG. 2E is a front cross-sectional view of the helmet shell with overlapping carbon sections in accordance with an illustrative embodiment.
Figure 2F:
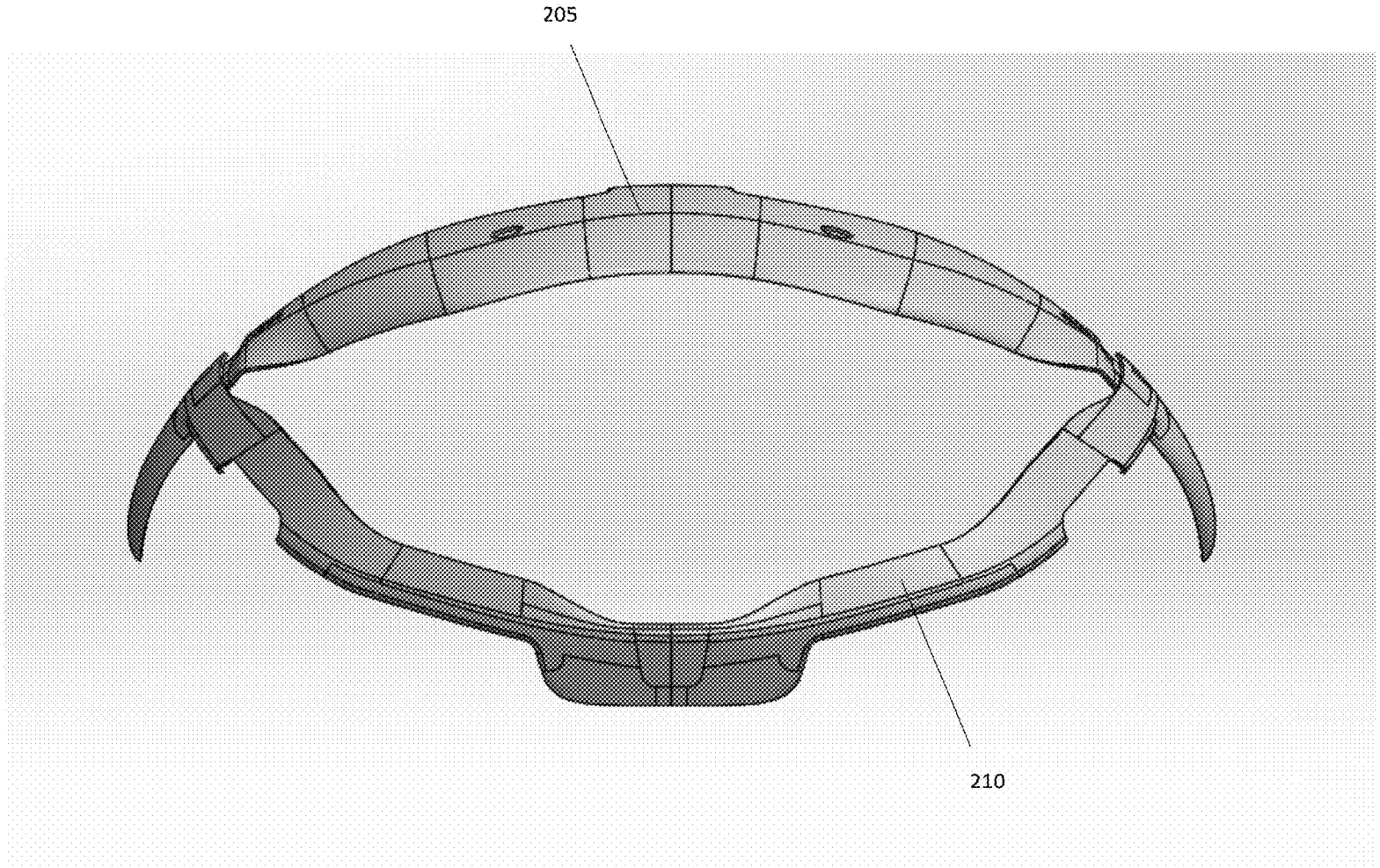
FIG. 2F is a front cross-sectional view of the overlapping carbon sections in accordance with an illustrative embodiment.
Figure 2G:
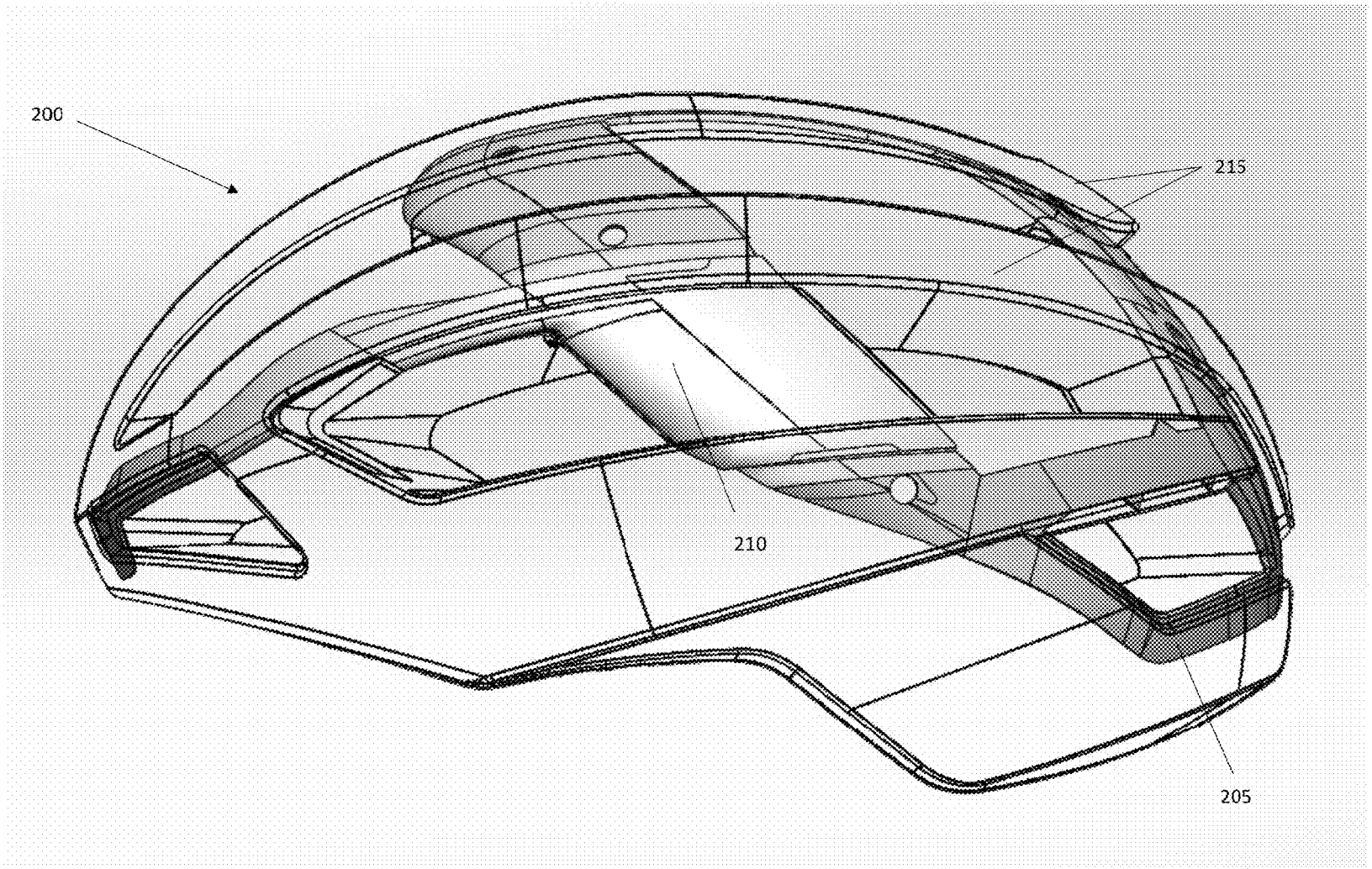
FIG. 2G is a left view of the helmet shell with overlapping carbon sections in accordance with an illustrative embodiment.
Figure 2H:
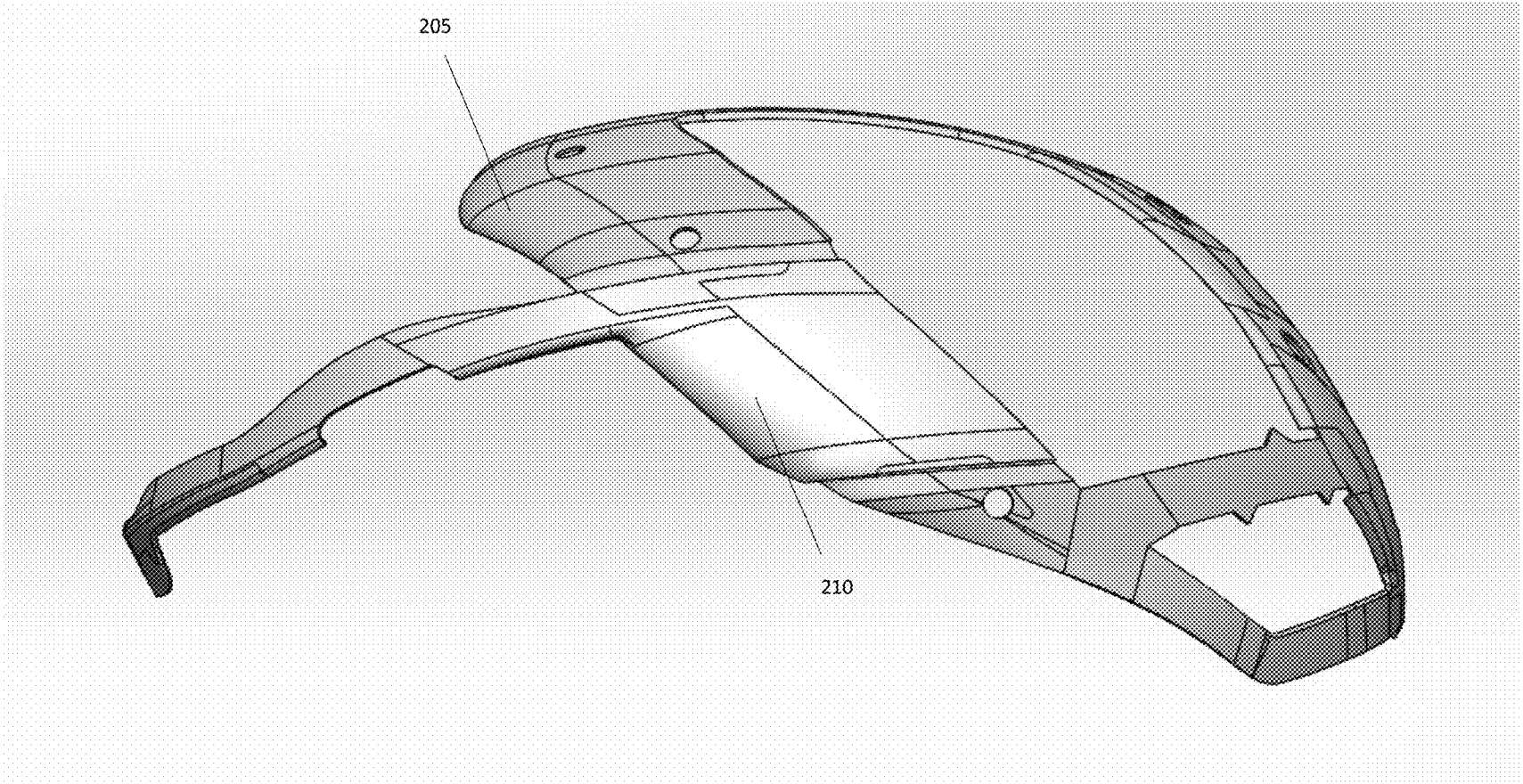
FIG. 2H is a left view of the overlapping carbon sections in accordance with an illustrative embodiment.
Figure 21:
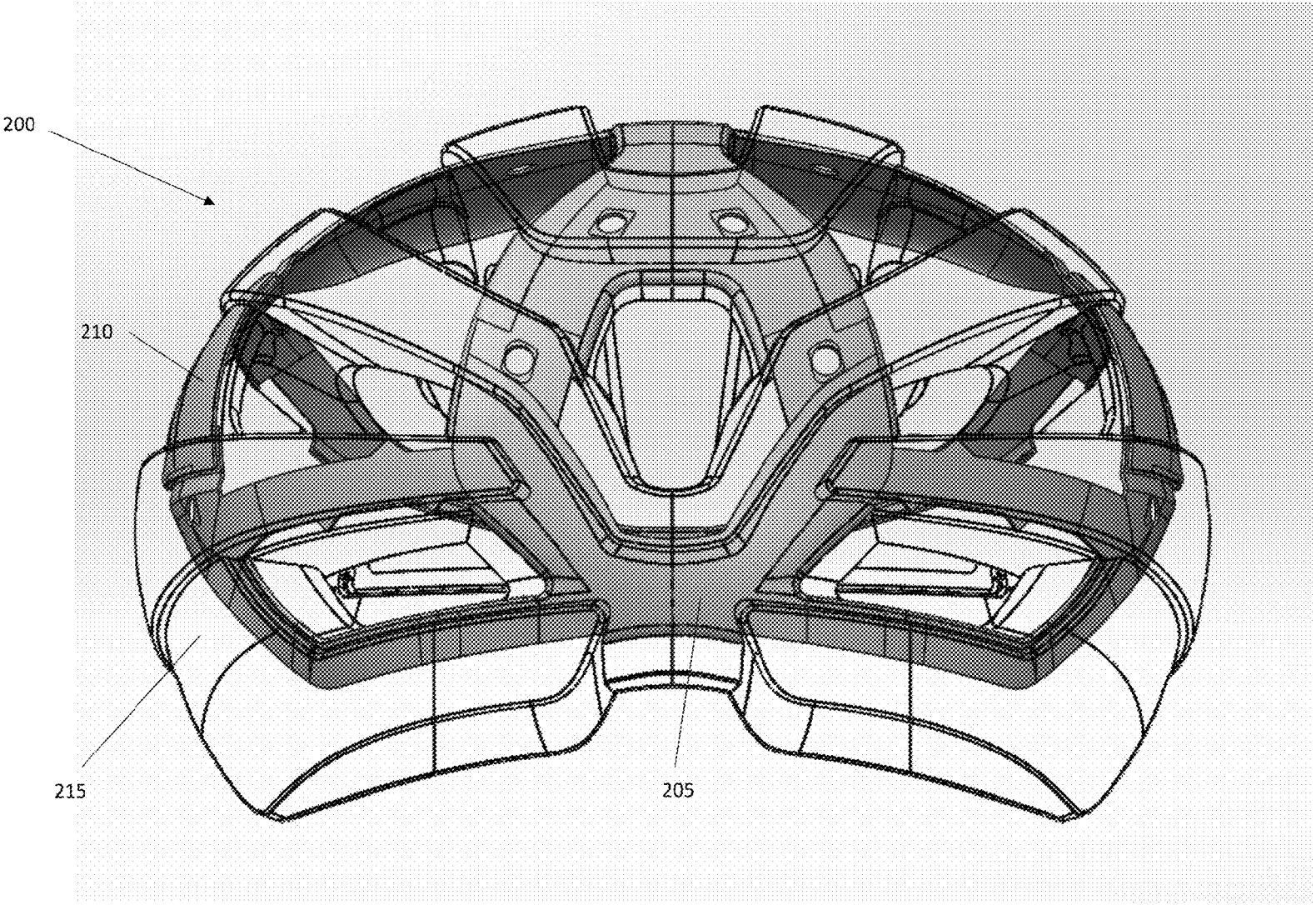
Figure 2J:
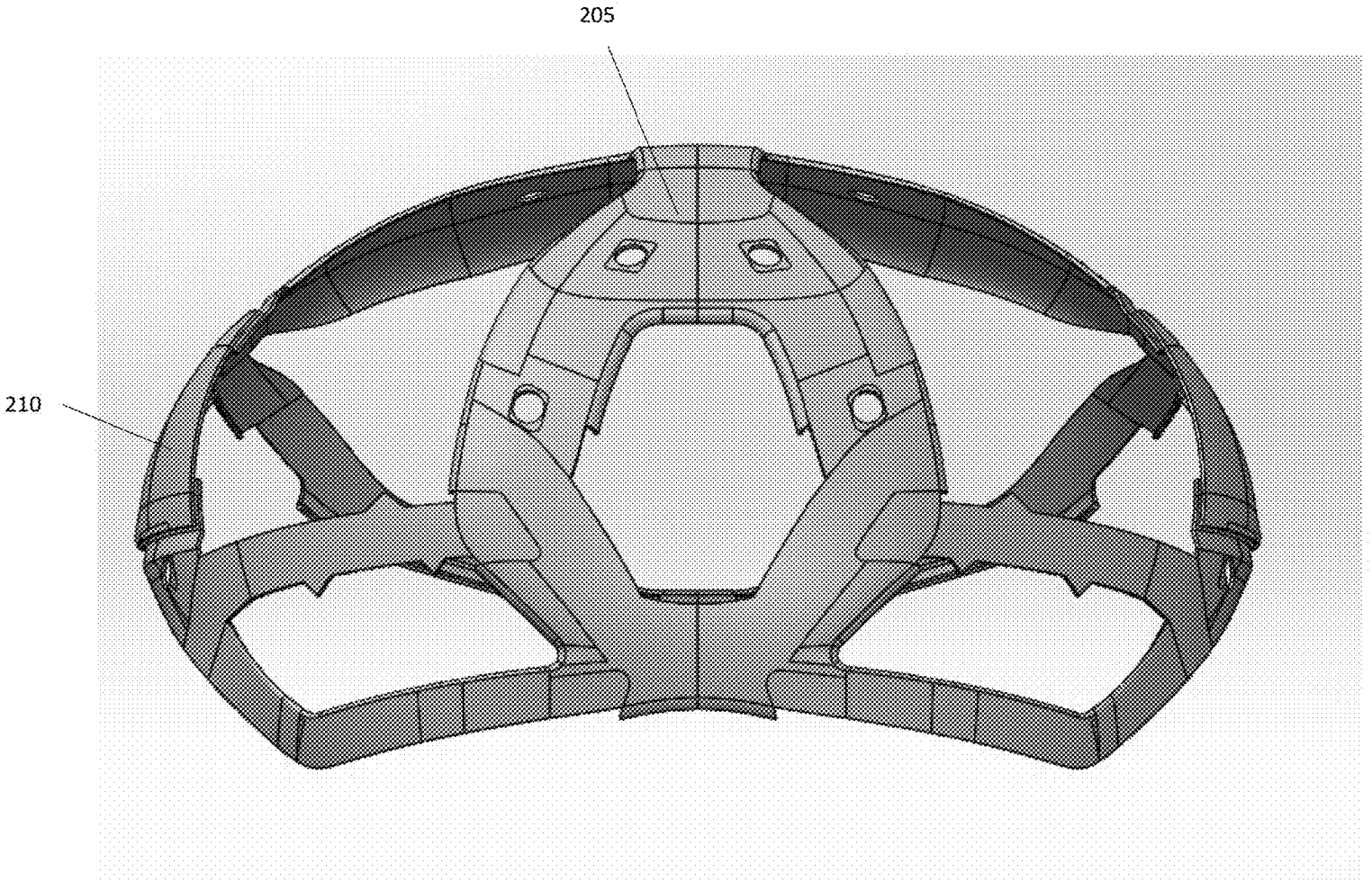
FIG. 2J is a rear view of the overlapping carbon sections in accordance with an illustrative embodiment.
Figure 2K:
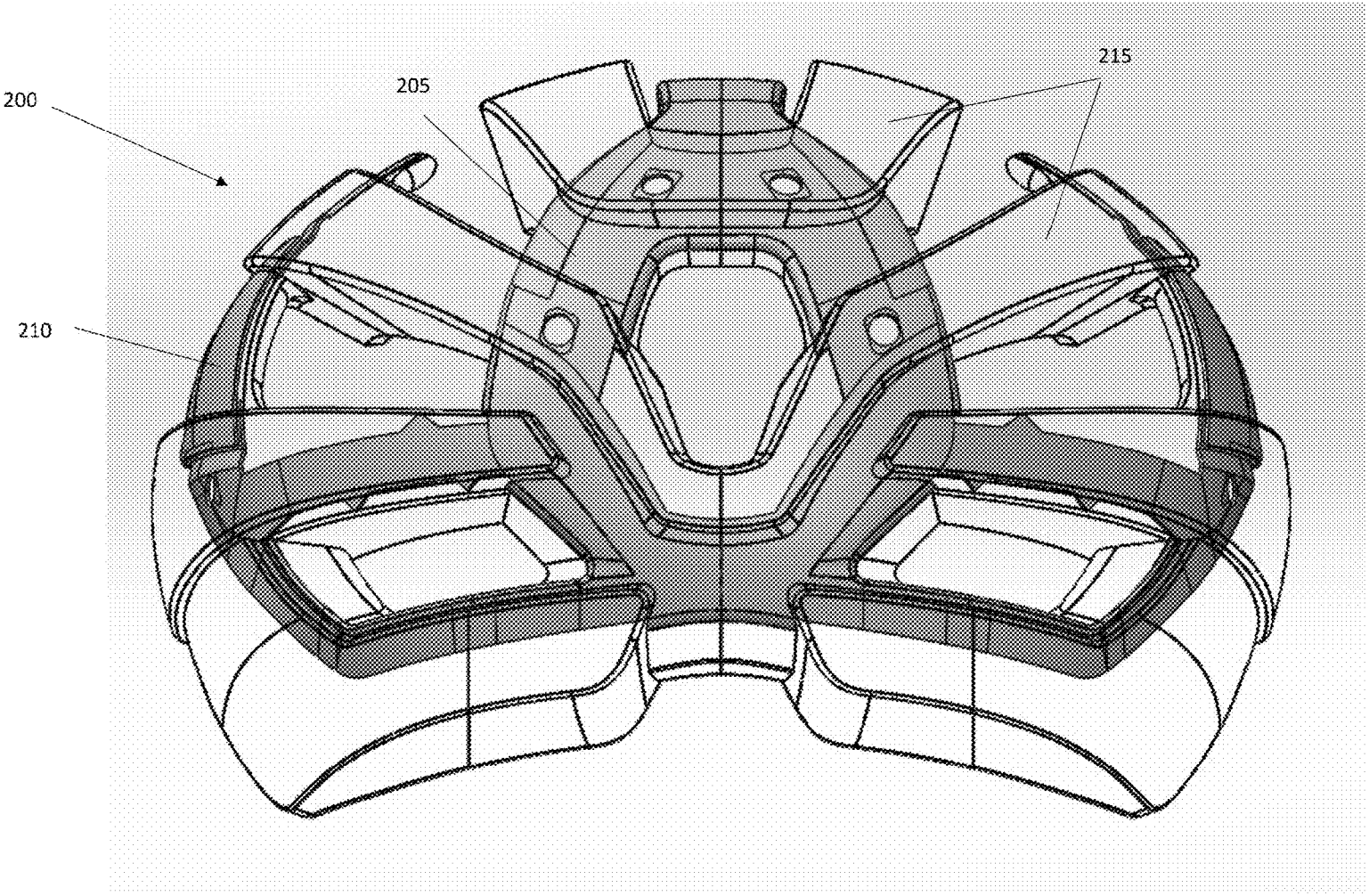
FIG. 2K is a rear cross-sectional view of the helmet shell with overlapping carbon sections in accordance with an illustrative embodiment.
Figure 2L:
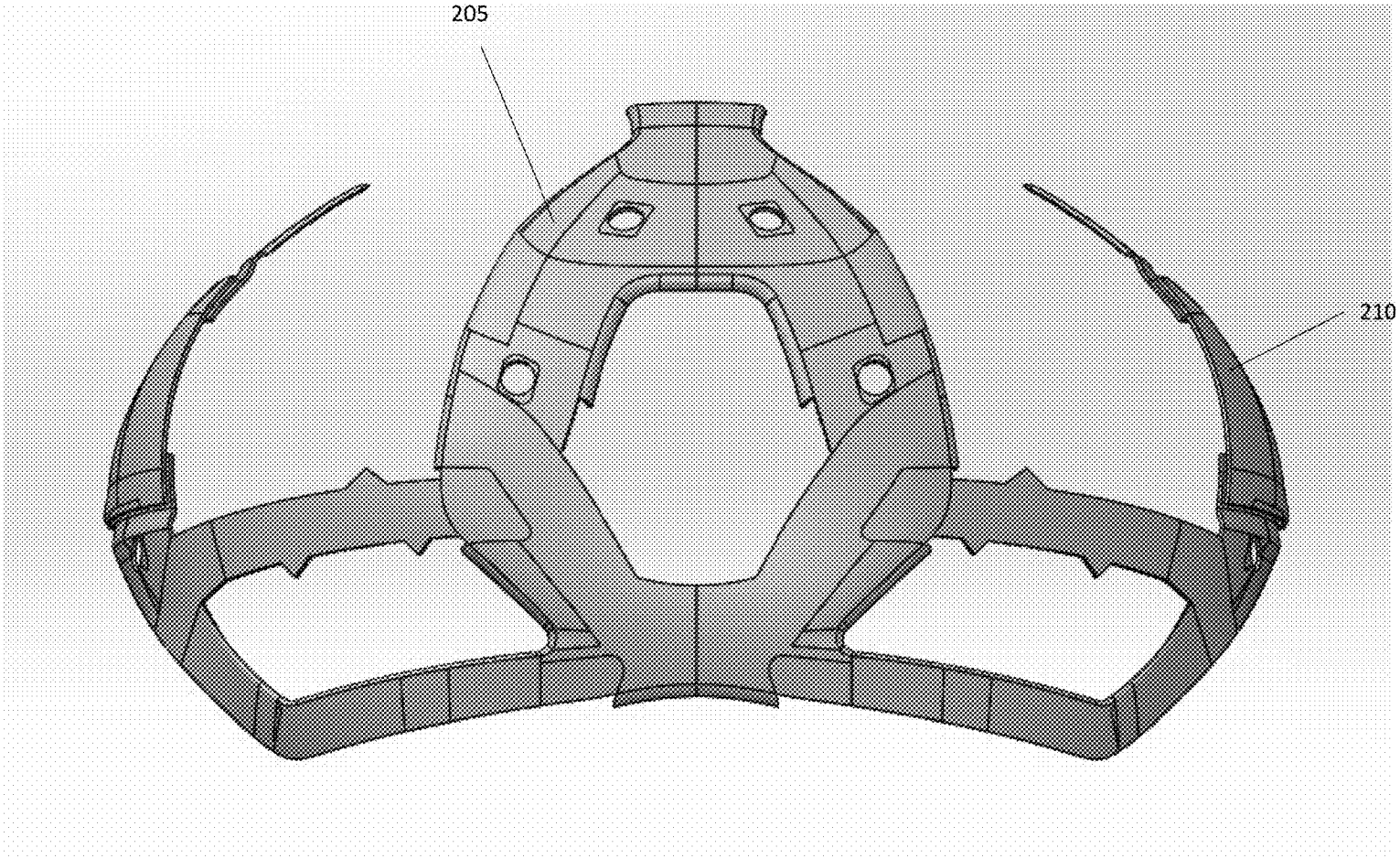
FIG. 2L is a rear cross-sectional view of the overlapping carbon sections in accordance with an illustrative embodiment.
Figure 2M:
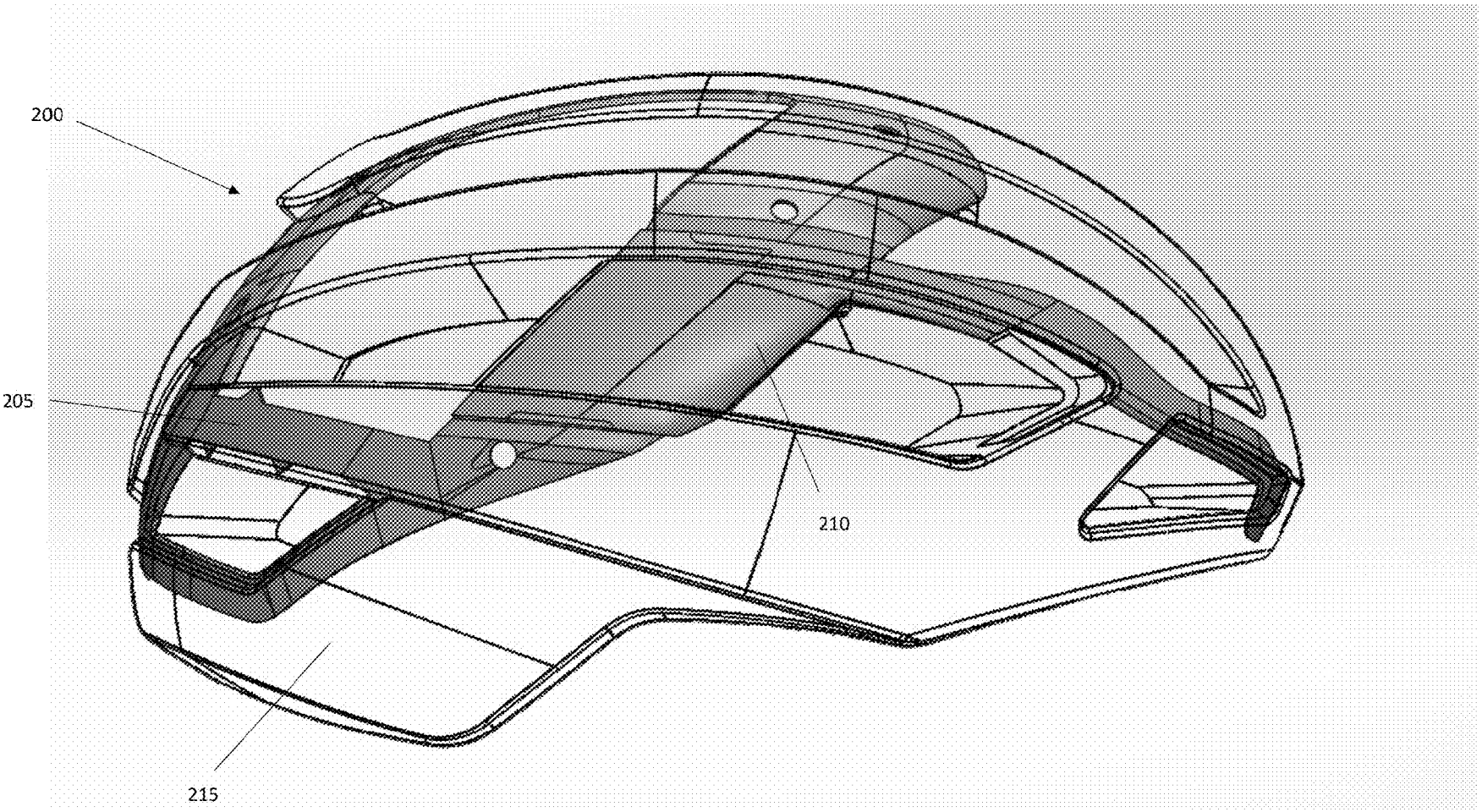
FIG. 2M is a right view of the helmet shell with overlapping carbon sections in accordance with an illustrative embodiment.
Figure 2N:
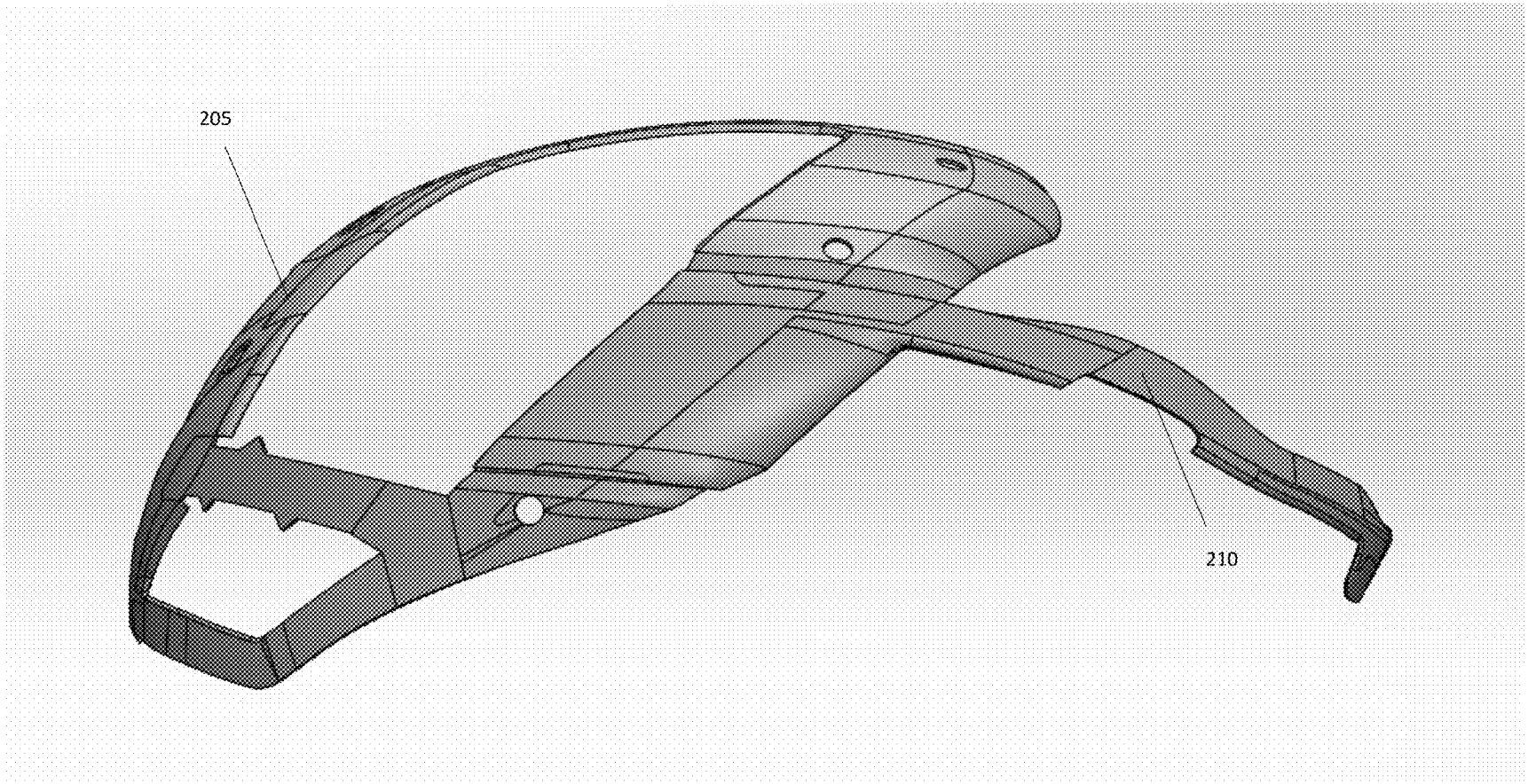
FIG. 2N is a right view of the overlapping carbon sections in accordance with an illustrative embodiment.
Figure 20:
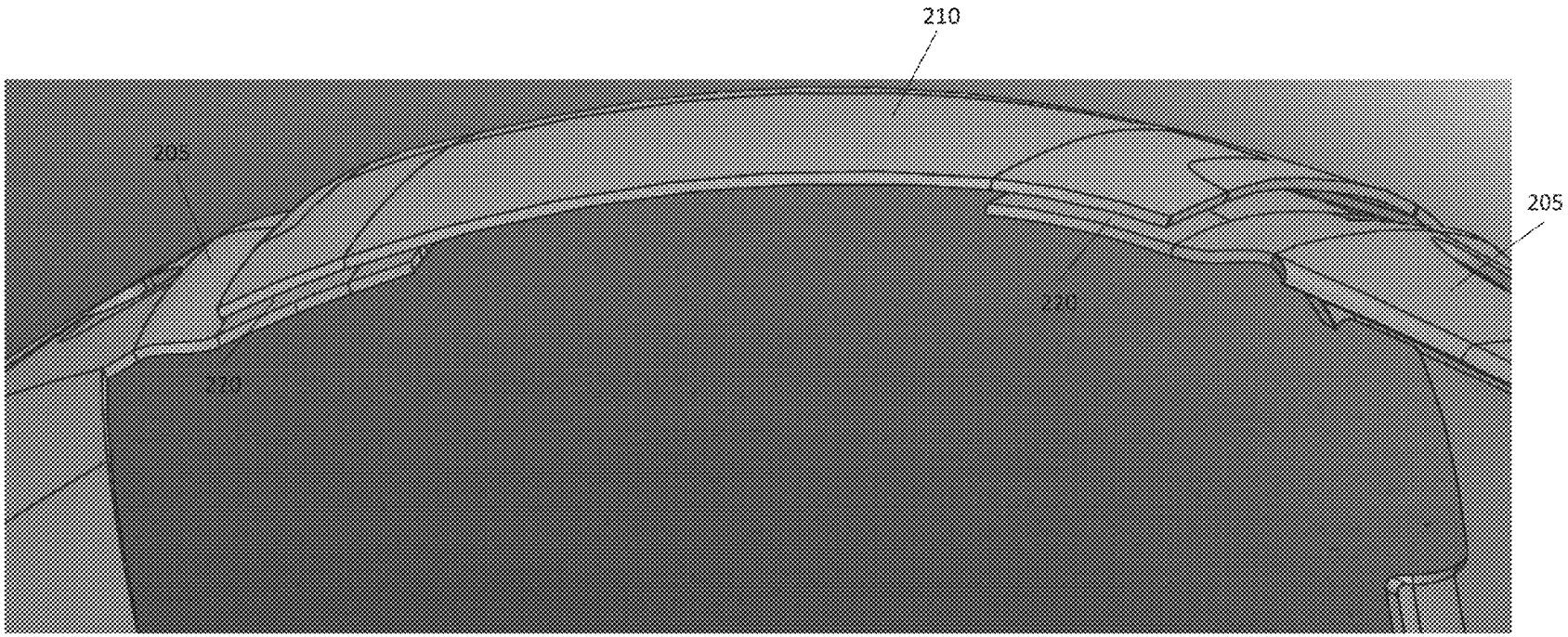
Figure 2P:
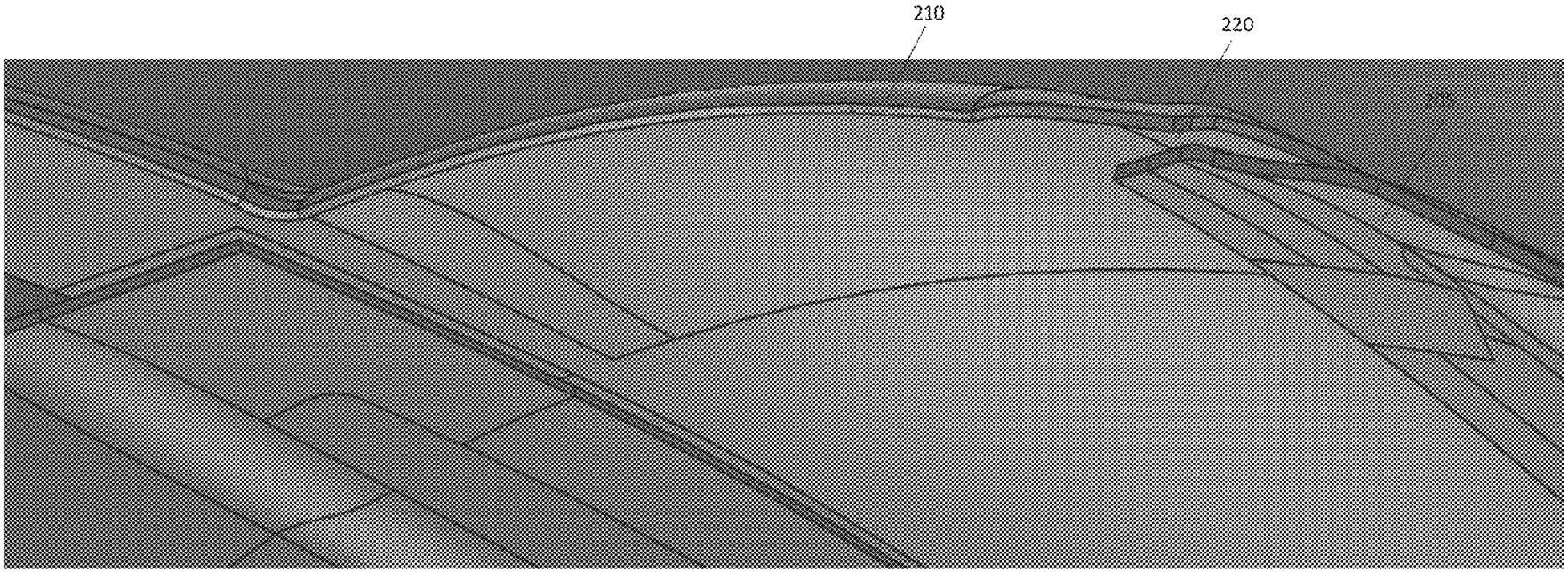
FIG. 2P is a second close-up partial view depicting overlapped carbon sections in accordance with an illustrative embodiment.
Figure 2Q:
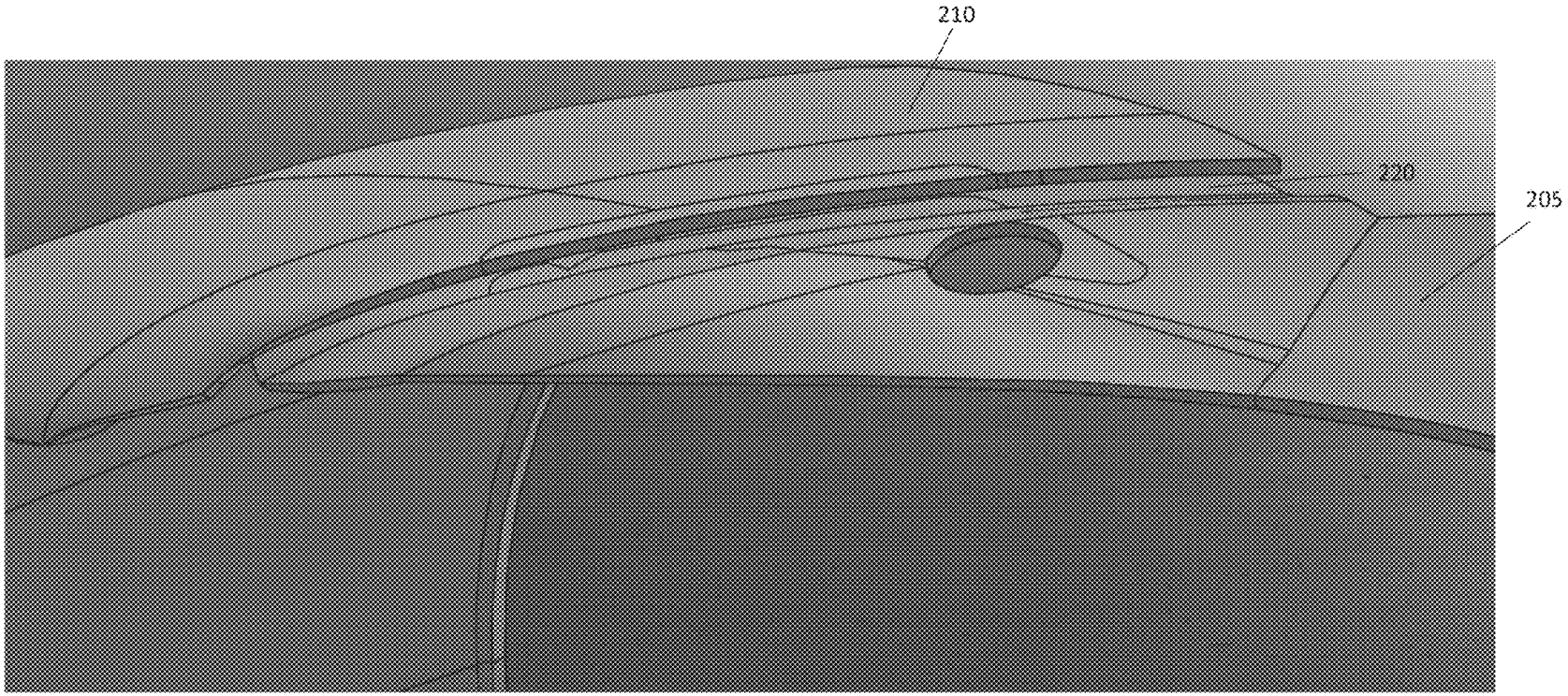
FIG. 2Q is a third close-up partial view depicting overlapped carbon sections in accordance with an illustrative embodiment.
Figure 2R:
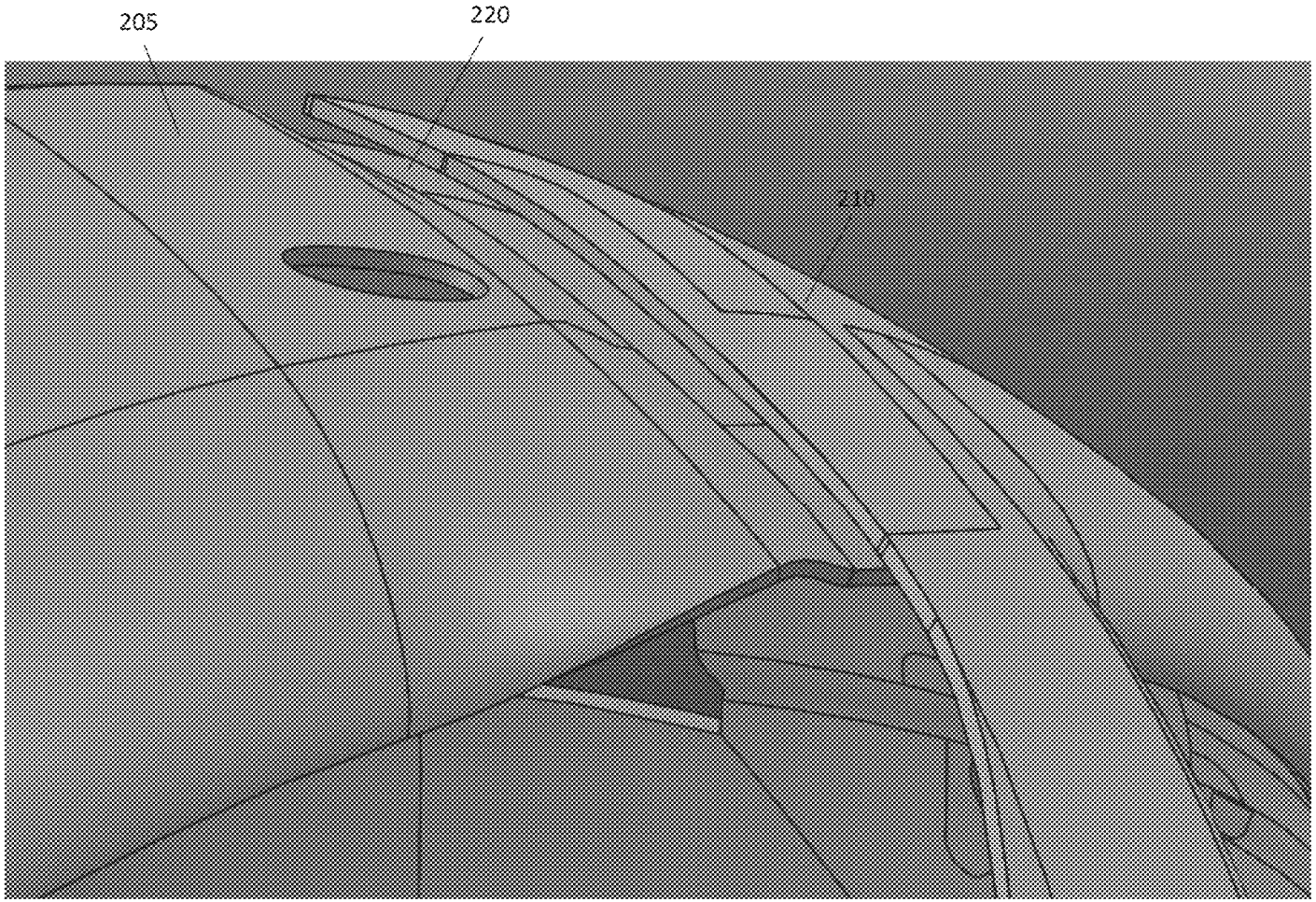
FIG. 2R is a fourth close-up partial view depicting overlapped carbon sections in accordance with an illustrative embodiment.

FIGS. 2A-2R depict various views of a helmet 200 formed with a carbon cage that is itself formed by adhering thermoformed carbon sections to one another. In the depicted embodiments, the helmet 200 includes a carbon cage that is formed from a first thermoformed carbon section 205 that is adhered to a second thermoformed carbon section 210. The first thermoformed carbon section 205 is at the rear of the helmet and the second thermoformed carbon section 210 is at the front of the helmet 200. In alternative embodiments, different carbon sections may be used. For example, in one embodiment, the first thermoformed carbon section can form the right side of the helmet and the second thermoformed carbon section can form the left side of the helmet. In alternative embodiments, additional thermoformed carbon sections may be used such that the helmet cage is formed from three sections, four sections, etc. Also shown is an energy absorbing layer 215 that partially surrounds the carbon cage. The energy absorbing layer 215 can be formed of one or more sections, depending on the implementation. In one embodiment, the material used to form the energy absorbing layer 215 can be EPS.

Referring specifically to the figures, FIG. 2A is a perspective view of a helmet shell with overlapping carbon sections in accordance with an illustrative embodiment. FIG. 2B is a perspective view of the overlapping carbon sections in accordance with an illustrative embodiment. FIG. 2C is a front view of the helmet shell with overlapping carbon sections in accordance with an illustrative embodiment. FIG. 2D is a front view of the overlapping carbon sections in accordance with an illustrative embodiment. FIG. 2E is a front cross-sectional view of the helmet shell with overlapping carbon sections in accordance with an illustrative embodiment. FIG. 2F is a front cross-sectional view of the overlapping carbon sections in accordance with an illustrative embodiment. FIG. 2G is a left view of the helmet shell with overlapping carbon sections in accordance with an illustrative embodiment. FIG. 2H is a left view of the overlapping carbon sections in accordance with an illustrative embodiment. FIG. 2I is a rear view of the helmet shell with overlapping carbon sections in accordance with an illustrative embodiment. FIG. 2J is a rear view of the overlapping carbon sections in accordance with an illustrative embodiment. FIG. 2K is a rear cross-sectional view of the helmet shell with overlapping carbon sections in accordance with an illustrative embodiment. FIG. 2L is a rear cross-sectional view of the overlapping carbon sections in accordance with an illustrative embodiment. FIG. 2M is a right view of the helmet shell with overlapping carbon sections in accordance with an illustrative embodiment. FIG. 2N is a right view of the overlapping carbon sections in accordance with an illustrative embodiment.

FIG. 2O is a first close-up partial view depicting overlapped carbon sections in accordance with an illustrative embodiment. FIG. 2P is a second close-up partial view depicting overlapped carbon sections in accordance with an illustrative embodiment. FIG. 2Q is a third close-up partial view depicting overlapped carbon sections in accordance with an illustrative embodiment. FIG. 2R is a fourth close-up partial view depicting overlapped carbon sections in accordance with an illustrative embodiment. The views in FIGS. 2O-2R show how first thermoformed carbon section 205 is overlapped by the second thermoformed carbon section 210. The views also show a gap 220 that is formed between the first thermoformed carbon section 205 and the second thermoformed carbon section 210. As discussed, the gap 220 is sized to receive an adhesive that bonds the thermoformed carbon sections to one another.

Figure 3:
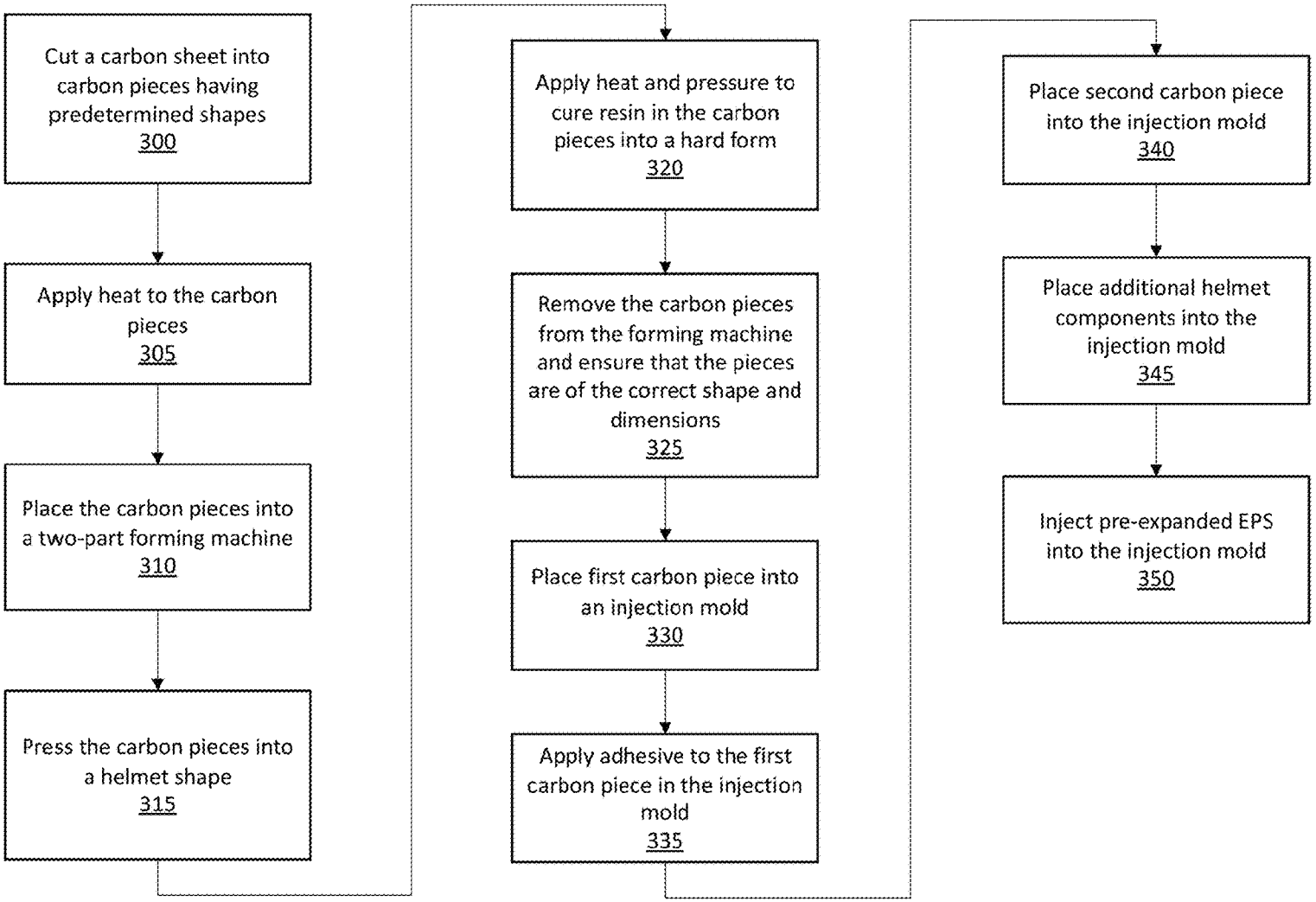
FIG. 3 is a flow diagram depicting operations performed to make a carbon shell helmet in accordance with an illustrative embodiment.

FIG. 3 is a flow diagram depicting operations performed to make a carbon shell helmet in accordance with an illustrative embodiment. In alternative embodiments, fewer, additional, and/or different operations may be performed. Also, the use of a flow diagram is not meant to be limiting with respect to the order of operations performed. In an operation 300, a carbon sheet is cut into pieces having predetermined shapes. The carbon sheet used to form the helmet shell can be selected based on desired characteristics such as weave, thickness, post-cure mechanical properties, etc. The carbon sheet can be cut using a laser, water jet, or other technique that provides a precision cut such that the pieces can be formed to within a desired tolerance (e.g., 0.5 mm). In an illustrative embodiment, the carbon sheet starts out as a flat sheet, and the predetermined shapes into which the carbon sheet is cut can be based on the size and type of helmet being made. In one embodiment, the carbon pieces cut out of the carbon sheet can include a first carbon piece that forms the front of the helmet and a second carbon piece that forms the rear of the helmet. In alternative embodiments, additional carbon pieces may be used to form the helmet.

In an operation 305, heat is applied to the carbon pieces that were cut out of the carbon sheet. The heat is part of a thermoforming process and can be applied by placing the carbon pieces into an oven, or by any other technique. The applied heat makes the carbon pieces more pliable so that they can be manipulated and positioned in a form. In an operation 310, the carbon pieces are placed into a two-part forming machine (or form). The two-part forming machine can include a positive side and a negative side. Specifically, the first carbon piece can be placed into a first part (or form) of the two-part forming machine and the second carbon piece can be placed into a second part (or form) of the two-part forming machine.

In an operation 315, the carbon pieces are pressed into a helmet shape. In an illustrative embodiment, the two-part forming machine applies heat and pressure (e.g., hydraulic pressure and/or pneumatic pressure) to press the sides of the form together, which in turn thermoforms the carbon pieces into the desired shapes to form the helmet. As discussed herein, the carbon pieces are formed such that there are areas of overlap between the carbon pieces. Additionally, the pieces are formed such that a gap is formed between the carbon pieces at the areas of overlap. The width of this gap is controlled to accommodate an adhesive of a desired thickness. In an operation 320, heat and pressure are applied to the formed carbon pieces to cure resin in the carbon pieces into a hard form. This ensures that the carbon pieces will retain their formed shape upon removal from the form.

In an operation 325, the formed carbon pieces are removed from the forming machine. A user (or associated computing system) can then measure and analyze the carbon pieces to ensure that the formed pieces are of the correct shape and dimensions. In an operation 330, the first carbon piece is placed into an injection mold. In an operation 335, adhesive is applied to the first carbon piece in the injection mold. The adhesive is applied to the areas of overlap between the first and second carbon pieces. Additionally, the thickness (or depth) of the adhesive is controlled to match a thickness of the gap formed in between the carbon pieces at the areas of overlap. In an operation 340, the second carbon piece is placed into the injection mold.

In an operation 345, additional helmet components are placed into the injection mold. The additional helmet components can include mushroom plugs, mounts for the fit system, etc. In an operation 350, pre-expanded EPS (expanded polystyrene) is injected into the injection mold to complete formation of the helmet. In an illustrative embodiment, any of the operations of FIG. 3 can be performed by a computing system that includes a processor, memory, user interface, etc. The memory can store computer-readable instructions that, upon execution by the processor, perform the operations described herein to form the helmet.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more".

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A helmet, comprising:

an outer shell;

an impact absorbing layer adjacent to the outer shell; and a fit system mounted to the impact absorbing layer, wherein the fit system includes:

a rear portion that includes a rotational mount having a ball and an extension mounted to the ball;

a rear mount that includes a plurality of grooves, wherein each groove in the plurality of grooves is a curved channel that includes a first portion, a second portion, and a third portion that are fluidly connected, wherein the first portion extends parallel to a line that extends from a front of the helmet to a back of the helmet, the second portion is perpendicular to the first portion, and the third portion is parallel to the first portion, wherein each groove in the plurality of grooves is configured to removably receive the rotational mount of the rear portion of the fit system, wherein the ball rotates within the groove of the plurality of grooves, wherein the ball and the groove are shaped such that downward rotation of the ball within the groove lowers the rear portion of the fit system into a first position in which the rear portion of the fit system extends downward from a bottom of the helmet, and wherein the ball and the groove are shaped such that upward rotation of the ball within the groove raises the rear portion of the fit system into a second position in which the rear portion of the fit system does not extend below the bottom of the helmet.

2. The helmet of claim 1, wherein the rear mount is incorporated into the impact absorbing layer.

3. The helmet of claim 1, wherein the ball of the rotational mount is configured to rest within the third portion of the curved channel.

4. The helmet of claim 3, wherein the extension mounted to the ball is positioned in the curved channel, and wherein the curved channel supports the extension in the first position in which the rear portion of the fit system is lowered to extend downward from the bottom of the helmet.

5. The helmet of claim 4, wherein the curved channel also supports the extension in the second position in which the rear portion of the fit system is raised and does not extend below the bottom of the helmet.

6. The helmet of claim 1, wherein the plurality of grooves are stacked vertically in the rear mount such that the rear portion of the fit system can be raised or lowered relative to a top of the helmet.

7. The helmet of claim 6, wherein the plurality of grooves comprises three grooves.

8. The helmet of claim 1, wherein the fit system further includes a front portion mounted to the impact absorbing layer.

9. The helmet of claim 8, further comprising a cord that connects the rear portion of the fit system to the front portion of the fit system, wherein the front portion of the fit system includes a track configured to receive at least a portion of the cord.

10. The helmet of claim 9, wherein a portion of the track includes a first track path and a second track path, and wherein the first track path positions the fit system at a first location relative to ears of a user and the second track path positions the fit system at a second location relative to the ears of the user.

11. The helmet of claim 10, wherein the first track path and the second track path are stacked vertically in the helmet.

12. The helmet of claim 8, wherein the front portion of the fit system includes a first terminal end on a right side of the helmet and a second terminal end on a left side of the helmet, and wherein each of the first terminal end and the second terminal end includes a track having a first track path and a second track path.

13. The helmet of claim 12, wherein the first track path and the second track path on the right side of the helmet and on the left side of the helmet are positioned between an ear and forehead of a wearer of the helmet.

* * * * *